US006426689B1

(12) United States Patent
Nakagawa et al.

(10) Patent No.: US 6,426,689 B1
(45) Date of Patent: Jul. 30, 2002

(54) ELECTROMAGNETIC RELAY

(75) Inventors: Masafumi Nakagawa; Fumihiro Kamitani; Osamu Matsui; Kazuhiro Nobutoki; Masanori Motoyama; Toyotaka Nishikawa, all of Mie (JP)

(73) Assignee: Matsushita Electric Works, Ltd., Kadoma (JP)

( * ) Notice: Subject to any disclaimer, the term of this patent is extended or adjusted under 35 U.S.C. 154(b) by 0 days.

(21) Appl. No.: 09/695,107

(22) Filed: Oct. 25, 2000

(30) Foreign Application Priority Data

Oct. 26, 1999 (JP) ..... 11-304734
Nov. 12, 1999 (JP) ..... 11-322700

(51) Int. Cl.[7] ..... H01H 51/22
(52) U.S. Cl. ..... 335/78; 335/80
(58) Field of Search ..... 335/78–86, 124, 335/128–31

(56) References Cited

U.S. PATENT DOCUMENTS 4,703,293 A * 10/1987 Ono et al. ..... 335/80
5,515,019 A * 5/1996 Schedele ..... 335/78

* cited by examiner

*Primary Examiner*—Lincoln Donovan
(74) *Attorney, Agent, or Firm*—Oblon, Spivak, McClelland, Maier & Neustadt, P.C.

(57) ABSTRACT

An electromagnetic relay includes a yoke having both ends bent in first direction, a coil portion wound onto a central part between the ends of the yoke, a permanent magnet arranged between the ends of the yoke, an armature formed to have a greater length than that between the ends of the yoke and provided on the first side of the permanent magnet and a hinge spring capable of causing both end sides of the armature to be toggle with respect to the ends of the yoke, and the hinge spring integrally fixing the permanent magnet and the armature.

8 Claims, 32 Drawing Sheets

ELECTROMAGNETIC RELAY

This application is based on a Japanese Patent Applications Hei. 11-304734 filed on Oct. 26, 2000, Hei. 11-322700 filed on Nov. 12, 1000 and 2000-182211 filed on Jun. 16, 2000, herein cooperated by reference.

BACKGROUND OF INVENTION

1. Field of Application

The present invention relates to an electromagnetic relay constituted by a yoke, a coil portion wound onto the yoke, an armature toggled and provided with respect to the yoke, and a moving contact and a fixed contact which are brought into a contact and separation state depending on the toggle motion of the armature.

2. Related art

FIGS. 1 to 3 show a conventional electromagnetic relay of this type. The electromagnetic relay comprises a yoke C having a winding space divided by a coil bobbin A, a coil B wound thereon and magnetic pole portions C1 and C2 provided on both ends, a pair of armatures D1 and D2 which are attracted into and separated from the magnetic pole portions C1 and C2 of the yoke C to be rotated depending on the excitation state of the coil B, a fixed contact plate E provided with a fixed contact E1, a movable spring F provided with a moving contact F1 opposite to the fixed contact E1, and a card G linked to the armatures D1 and D2 for displacing the movable spring F such that the moving contact F1 abuts on or separates from the fixed contact E1 depending on the rotating operation of the armatures D1 and D2.

The yoke C forms a coil block CC together with the coil bobbins A and B. Moreover, the armatures D1 and D2 interpose a permanent magnet H therebetween, and is formed of a molding material integrally with the permanent magnet H. Thus, an armature block DD is formed. A portion J thus formed integrally is provided with a support portion J1 rotatably supported on a body K in which parts such as the armature block DD and the coil block CC are arranged, and furthermore, is provided with a lever J2 extended and linked to one of ends of the card G having the other end connected to the movable spring F.

The lever J2 is connected to the yoke C through an adjusting spring L to be rotatably supported in a state in which a clearance GG is formed between both magnetic pole portions C1 and C2 of the yoke C respectively. The clearance GG between the magnetic pole portions C1 and C2 of the yoke C and the armatures D1 and D2 is regulated by properly changing the shape of the adjusting spring L. By thus regulating the clearance GG, a working voltage of the abutting and separating operation of both contacts E1 and F1 can be regulated so that a sensitivity of the abutting and separating operation of the contacts E1 and F1 can be regulated.

When a current is caused to flow in a preset direction so that the coil B is excited, an end D11 of the armature D1 is attracted into the magnetic pole portion C1 on one end of the yoke C and the other end D22 of the armature D2 is attracted into the magnetic pole portion C2 on the other end of the yoke C such that a closed magnetic circuit is formed. Consequently, the armature block DD is rotated clockwise in FIG. 17. As a result, the card G linked to the lever J2 of the armature block DD is driven toward the movable spring F, and the movable spring F connected to the driven card G is displaced toward the fixed contact plate E so that the moving contact F1 of the movable spring F abuts on the fixed contact E1 of the fixed contact plate E. When the excitation of the coil B is stopped, this state is held.

When a current is caused to flow in a direction reverse to the above-mentioned direction so that the coil B is excited in this state, an end D12 of the armature D1 is attracted into the magnetic pole portion C2 on the other end of the yoke C and one end D21 of the armature D2 is attracted into the magnetic pole portion C1 on one end of the yoke C such that a closed magnetic circuit is formed. Consequently, the armature block DD is rotated counterclockwise in FIG. 2. As a result, the card G linked to the lever J2 of the armature block DD is driven in such a direction as to go away from the movable spring F, and the movable spring F connected to the driven card G is displaced apart from the fixed contact plate E so that the moving contact F1 of the movable spring F is separated from the fixed contact E1 of the fixed contact plate E. When the excitation of the coil B is stopped, this state is held.

With such a structure, however, the armature block DD is positioned in three points, that is, the magnetic pole positions B1 and B2 and the fulcrum J1. Therefore, a variation in the dimensions of parts causes a clearance to be generated between the end of the magnetic pole portion C2 and the armature D22 of the armature block J in either of the magnetic pole positions B1 and B2 (the B2 side in an example of FIG. 3) as shown in FIG. 3. As a result, a fluctuation in a magnetic characteristic is increased so that a shock resistance is deteriorated. Moreover, it is very difficult to regulate a sensitivity.

In this phenomenon, the following troublesome are to be caused , as shown in FIG. 2, the clearance GG is formed in two portions between the armatures D1 and D2 and the magnetic pole portions C1 and C2 of the yoke C. Therefore, in a state in which the sensitivity of the abutting and separating operation of the contacts E1 and F1 is regulated, the clearance GG in at least one of the two portions remains so that a variation in suction force is increased. Consequently, it is hard to regulate the sensitivity of the abutting and separating operation of the contacts E1 and F1.

SUMMARY OF INVENTION

The invention has been made in consideration of the circumstances and has an object to provide an electromagnetic relay in which a fluctuation in a magnetic characteristic is small, a shock resistance is enhanced and a sensitivity can be regulated easily.

Another object is to provide an electromagnetic relay capable of easily regulating a sensitivity of the abutting and separating operation of both contacts.

In order to solve the problem, a first aspect of the invention is directed to an electromagnetic relay comprising a yoke having both ends bent in one direction, a coil portion wound onto a central part between the ends of the yoke, a permanent magnet provided between the ends of the yoke, an armature formed to have a greater length than that between the ends of the yoke and provided on the one direction side with respect to the permanent magnet, and a hinge spring capable of causing both end sides of the armature to be toggled with respect to the ends of the yoke, thereby integrally fixing the permanent magnet and the armature, wherein a protrusion is provided between the permanent magnet and the armature.

With such a structure, the position of the armature is determined by two points of the protrusion and either of the positions of magnet poles. Therefore, an unnecessary clearance is not generated so that a magnetic gap is not caused.

Consequently, a fluctuation in a magnetic characteristic is reduced so that a shock resistance can be enhanced. Moreover, a sensitivity can be regulated easily.

The electromagnetic relay according to the first aspect of the invention may further comprise an auxiliary yoke formed like a plate having a length which is almost equal to the length between the ends of the yoke and provided on a side reverse to the one direction with respect to the permanent magnet, the permanent magnet being formed like a plate having a smaller length than that between the ends of the yoke, the armature being formed like a plate and having the protrusion on a face opposed to the permanent magnet, the hinge spring being formed to have a central part attached to a face on the one direction side in the armature and both side parts extended from the central part in a direction reverse to the one direction, attached to both side faces of the auxiliary yoke respectively, and having both side parts interposing the permanent magnet therebetween, and the permanent magnet, the armature and the auxiliary yoke being integrally fixed with the hinge spring. According to such a structure, a fluctuation in a magnetic characteristic is reduced so that a shock resistance can be enhanced. Moreover, a sensitivity can be regulated easily.

In the electromagnetic relay according to the first aspect of the invention, the permanent magnet may be formed like a plate having a length which is almost equal to that between the ends of the yoke, the armature may be formed like a plate and may have the protrusion on a face opposed to the permanent magnet, the hinge spring may be formed to have a central part attached to a face on the one direction side in the armature and both side parts extended from the central part in a direction reverse to the one direction and attached to both side faces of the permanent magnet respectively, and the permanent magnet and the armature may be integrally fixed with the hinge spring. According to such a structure, a fluctuation in a magnetic characteristic is reduced so that a shock resistance can be enhanced. Moreover, a sensitivity can be regulated easily. Furthermore, a size can be reduced still more.

The electromagnetic relay according to the first aspect of the invention may further comprise an auxiliary yoke formed like a plate having a length which is almost equal to the length between the ends of the yoke and provided on a side reverse to the one direction with respect to the permanent magnet, the permanent magnet being formed like a plate having a smaller length than that between the ends of the yoke, the armature being formed like a plate and having the protrusion on a face opposed to the permanent magnet, the hinge spring being formed to have a central part attached to a face on a direction side reverse to the one direction in the armature and both side parts extended from the central part in the reverse direction, attached to both side faces of the auxiliary yoke respectively and interposing the permanent magnet therebetween, and the permanent magnet, the armature and the auxiliary yoke being integrally fixed with the hinge spring. According to such a structure, a fluctuation in a magnetic characteristic is reduced so that a shock resistance can be enhanced. Moreover, a sensitivity can be regulated easily. Furthermore, it is possible to suitably prevent wear from being caused by a toggle motion of an armature block including the permanent magnet, the armature and the auxiliary yoke which are integrated with the hinge spring.

The electromagnetic relay according to the second or fourth aspect of the invention may further comprise a device body having a body and a cover, the auxiliary yoke having a fixing portion to the body. With such a structure, assembly can easily be carried out.

In the electromagnetic relay according to the fifth aspect of the invention, the fixing portion may include a plurality of protrusions and the body may be provided with a groove in which the protrusion is to be fitted. With such a structure, assembly can easily be carried out.

The electromagnetic relay according to any of the first to sixth aspects of the invention may further comprise a fixed contact spring block including a fixed side terminal, a leaf spring fastened to the fixed side terminal, and a fixed contact provided on the leaf spring, a moving contact spring block including a moving side terminal, a leaf spring fastened to the moving side terminal and a moving contact provided on the leaf spring, and a card attached to both of the armature and the moving contact spring block for causing the fixed contact and the moving contact to come in contact with or separate from each other depending on a toggle motion of the armature. According to such a structure, a fluctuation in a magnetic characteristic is reduced so that a shock resistance can be enhanced. Moreover, a sensitivity can be regulated easily.

As is apparent from the foregoing, according to the seventh aspect of the invention, an electromagnetic relay comprises a yoke having both ends bent in one direction, a coil portion wound onto a central part between both ends of the yoke, a plate-shaped permanent magnet having a smaller length than that between the ends of the yoke, an auxiliary yoke formed like a plate having a length which is almost equal to that between the ends of the yoke and provided in a direction reverse to the one direction with respect to the permanent magnet, an armature formed to have a greater length than that between the ends of the yoke and attraced into or separated from a magnetic pole portion of the yoke for being rotated depending on an excitation state of the coil portion, a hinge spring for causing both end sides of the armature to be toggled, thereby integrally fixing the permanent magnet, the auxiliary yoke and the armature, a fixed contact plate having a fixed contact, a movable spring having a moving contact opposed to the fixed contact, and a card engaged with the armature for displacing the movable spring such that the moving contact abuts on or separates from the fixed contact depending on a rotating operation of the armature, wherein the hinge spring has a central part attached to a surface in the one direction of the armature and both ends extended from the central part in a direction reverse to the one direction and attached to both side walls of the auxiliary yoke through concavo-convex fitting with the armature and the permanent magnet held, and the auxiliary yoke has a concavo-convex disengagement prevention structure. Therefore, it is possible to provide an electromagnetic relay which changes a characteristic with difficulty even if a vibration or an impact is applied.

According to the eighth aspect of the invention, in the electromagnetic relay according to the seventh aspect of the invention, the hinge spring has a hole on each of both ends and the auxiliary yoke has a protrusion fitted in each hole on the both ends, the protrusion being bent in the direction reverse to the one direction as the disengagement prevention structure. Therefore, the protrusion bent in the direction reverse to the one direction engages the peripheral portion of the hinge spring. Consequently, the protrusion slips off from the hole of the hinge spring with difficulty.

According to the ninth aspect of the invention, in the electromagnetic relay according to the seventh aspect of the invention, the hinge spring has a hole on each of both ends and the auxiliary yoke has a protrusion fitted in each hole on the both ends, the protrusion having, as the disengagement prevention structure, a V-shaped groove for fitting the peripheral portions of the corresponding holes of the ends on the surface in the direction reverse to the one direction. Therefore, the peripheral portion of the corresponding hole is fitted in the V-shaped groove. Consequently, the protrusion slips off from the hole of the hinge spring with difficulty.

According to the tenth aspect of the invention, in the electromagnetic relay according to the seventh aspect of the invention, the hinge spring has a hole on each of both ends and the auxiliary yoke has a protrusion fitted in each hole on the both ends, the protrusion having, as the disengagement prevention structure, a hook-shaped click portion extended in the direction reverse to the one direction. Therefore, the click portion provided on each protrusion engages the peripheral portion of the hole of the hinge spring. Consequently, the protrusion slips off from the hole of the hinge spring with difficulty.

According to the eleventh aspect of the invention, if the opposed distance between both contacts is regulated to be smaller by elastically deforming the movable spring in the direction of the displacement thereof, the sensitivity of the abutting and separating operation of the contacts is increased. To the contrary, if the opposed distance between the contacts is regulated to be longer, the sensitivity of the abutting and separating operation of the contacts is reduced. Consequently, the sensitivity of the abutting and separating operation of the contacts can be regulated. Thus, the sensitivity of the abutting and separating operation of the contacts can be regulated by elastically deforming the movable spring in the direction of the displacement thereof. Therefore, it is not necessary to provide a clearance for sensitivity regulation between the magnetic pole portion of the yoke and the armature, and suction force is not varied. Consequently, the sensitivity of the abutting and separating operation of the contacts can be regulated easily.

According to the twelfth aspect of the invention, in addition to the effects of the electromagnetic relay according to the eleventh aspect of the invention, the movable spring is elastically deformed by the pressing portion in the direction of the displacement thereof. Therefore, the amount of elastic deformation can be regulated by increasing or reducing the pressing force of the pressing portion. Furthermore, the sensitivity of the abutting and separating operation of the contacts can be regulated easily.

According to the thirteenth aspect of the invention, in addition to the effects of the electromagnetic relay according to the twelfth aspect of the invention, the pressing portion is provided on the movable terminal itself. Therefore, it is not necessary to provide the pressing portion by particularly paying attention such that the pressing portion abuts on the movable terminal to generate a mutual interference. Thus, assembly can be carried out easily.

According to the fourteenth aspect of the invention, in addition to the effects of the electromagnetic relay according to the twelfth or thirteenth aspect of the invention, the movable spring locally decreases the spring force of the portion to be pressed by the pressing portion. Therefore, slight elastic deformation can be carried out in the direction of the displacement, and the sensitivity of the abutting and separating operation of the contacts can be regulated with high precision.

According to the fifteenth aspect of the invention, in addition to the effects of the electromagnetic relay according to any of the twelfth to fourteenth aspects of the invention, the press state of the pressing portion can be adjusted by elastically deforming the portion to be pressed by the pressing portion in the direction of the displacement. Therefore, the elastic deformation can be slightly adjusted in the direction of the displacement, and the sensitivity of the abutting and separating operation of the contacts can be regulated with high precision.

According to the sixteenth aspect of the invention, in addition to the effects of the electromagnetic relay according to any of the eleventh to fifteenth aspects of the invention, the current also flows to the contact portion extended from the fixed terminal as well as the fixed contact plate when both contacts abut. Therefore, the current flowing to the fixed contact plate can be decreased so that heat generation can be suppressed.

According to the seventeenth aspect of the invention, in addition to the effects of the electromagnetic relay according to the sixteenth aspect of the invention, the fixed contact plate obtains the prepressures of both contacts. Therefore, the contact pressure can be obtained through the abutment of the contacts.

BRIEF DESCRIPTION OF DRAWINGS

FIG. 26(*b*) is a partially enlarged view of FIG. 26(*b*) and a current flow of electromagnetic repulsion)

FIG. 27(*b*) is a side view showing the contact position.

FIG. 27(*c*) shows a relationship between a contact position and a contact pressure which is obtained with or without application of the prepresssure

DETAILED DESCRIPTION OF PREFERRED EMBODIMENTS

First Embodiment

Figure 1:
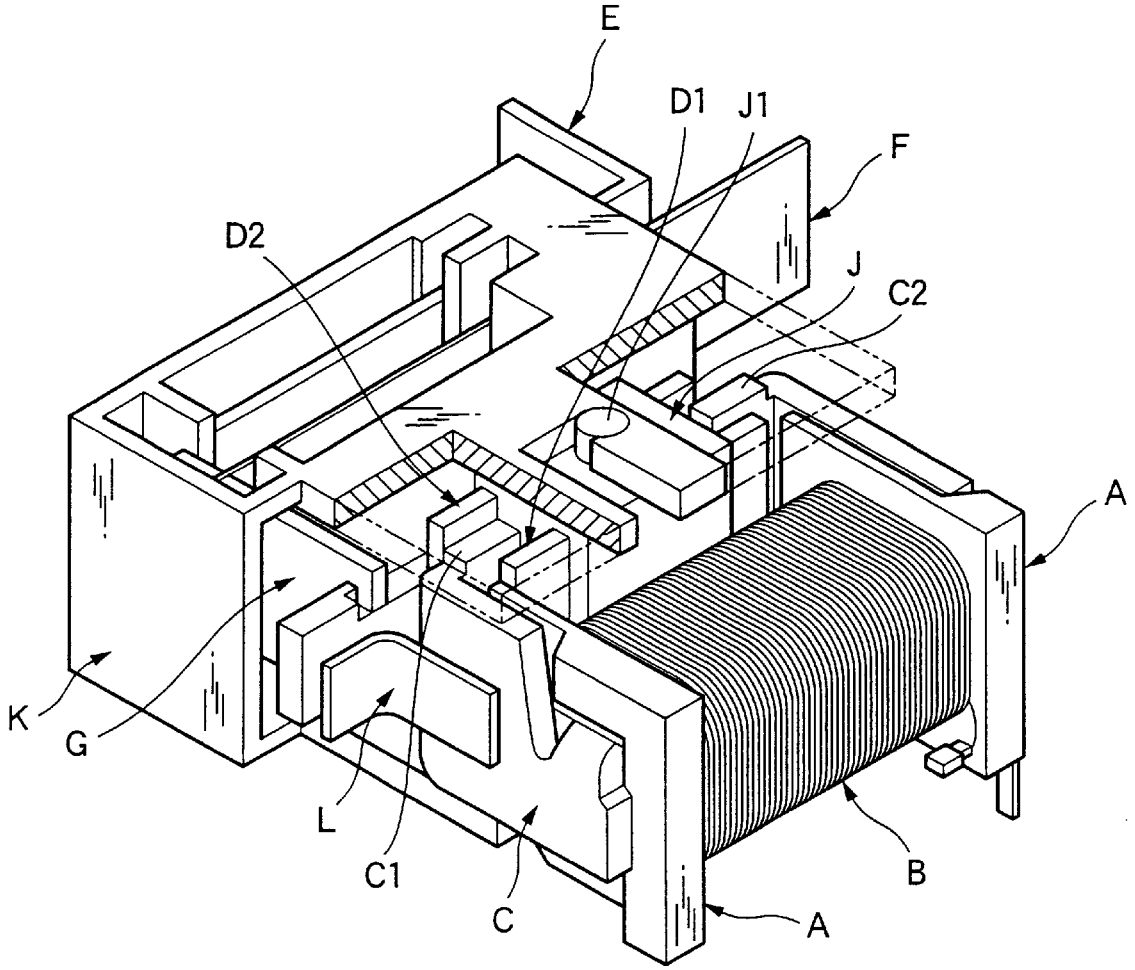
FIG.1 PRIOR ART
FIG. 1 is a perspective view showing a conventional example.
Figure 2:
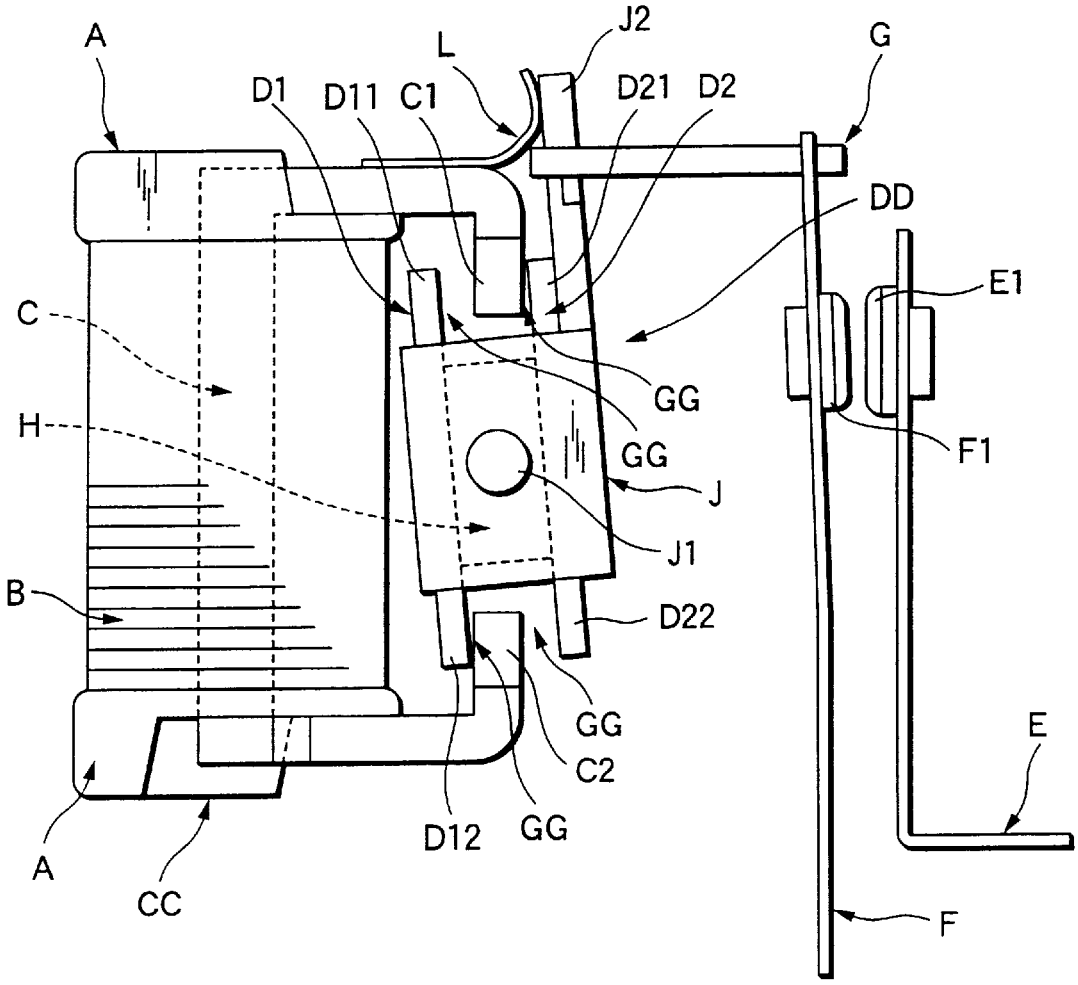
FIG.2 PRIOR ART
FIG. 2 is a front view showing an operation according to the conventional example.
Figure 3:
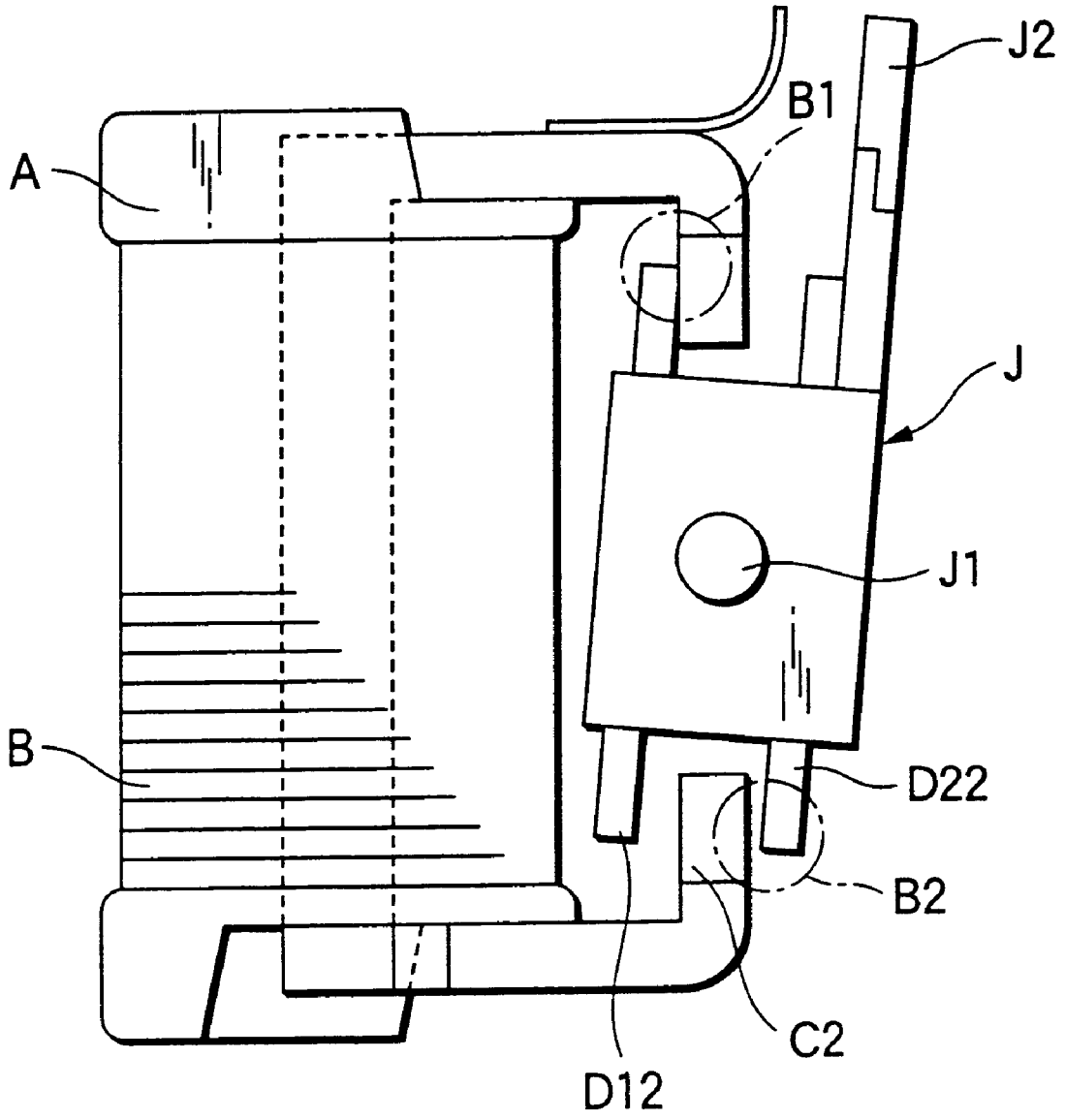
FIG.3 PRIOR ART
FIG. 3 is a view illustrating the drawback of the electromagnetic relay shown in FIG. 2.
Figure 4:
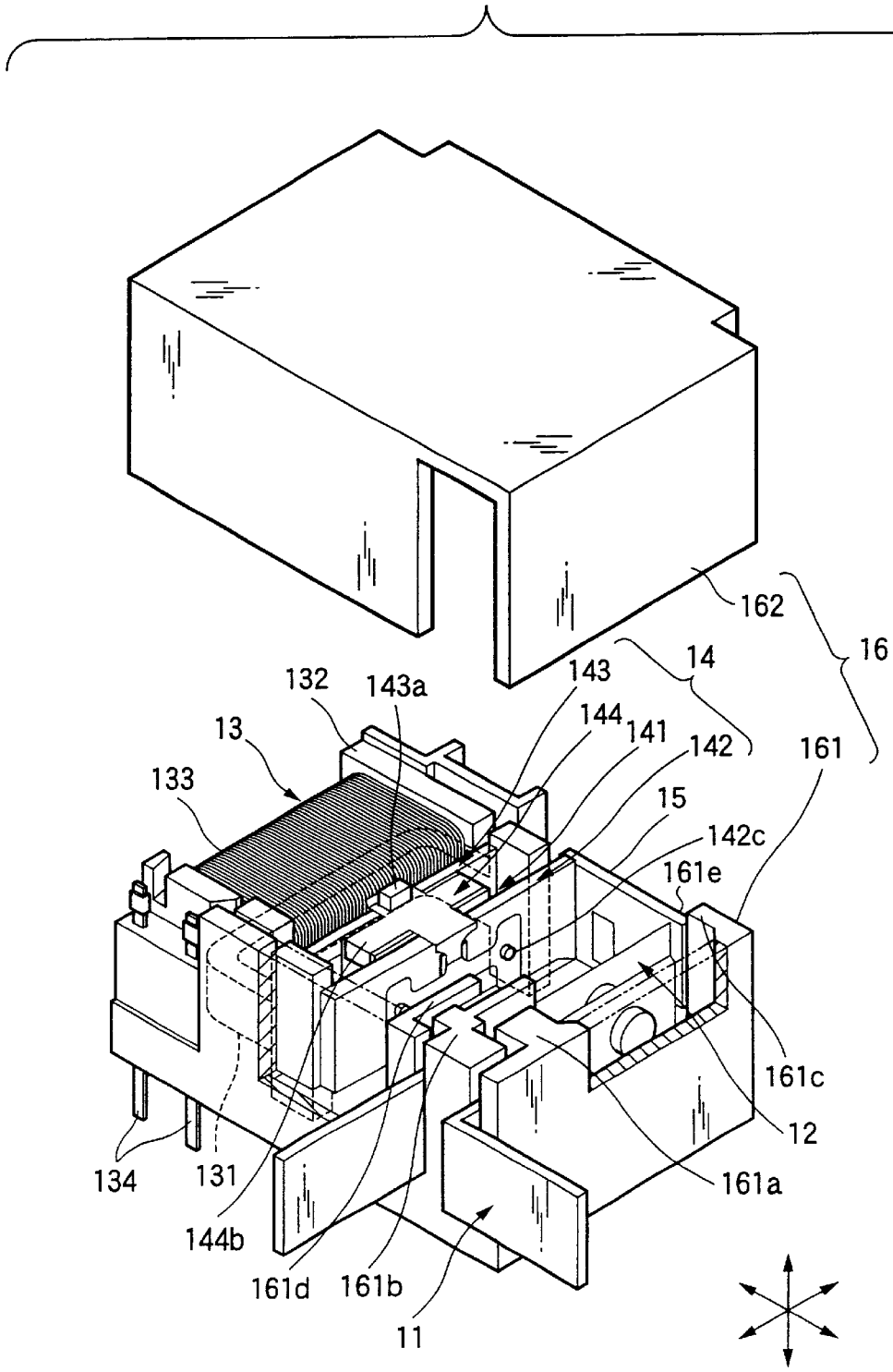
FIG. 4 is a perspective view showing an electromagnetic relay according to a first embodiment of the invention, which is partially taken away.
Figure 5A:
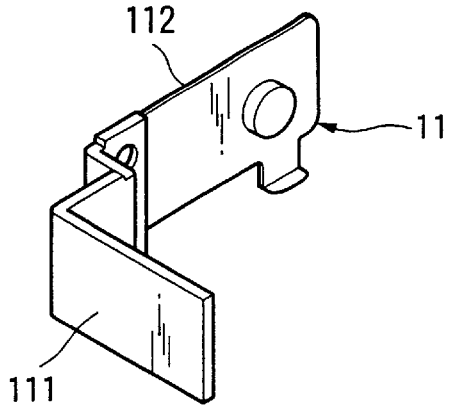
FIGS. 5(*a*) to 5(*d*) are perspective views showing a fixed contact spring block, a moving contact spring block, a yoke and a card illustrated in FIG. 1, respectively.
Figure 5B:
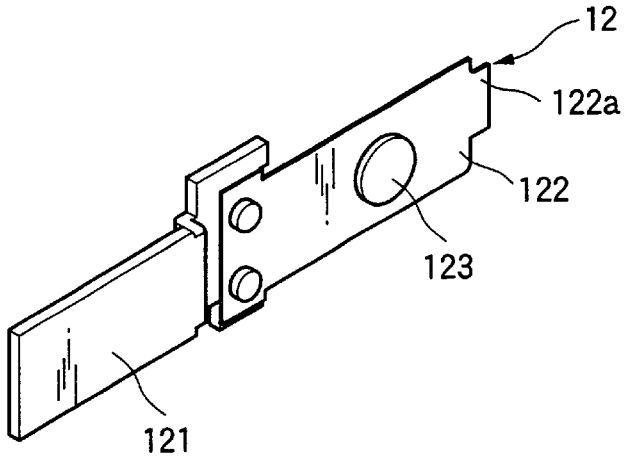
Figure 5C:
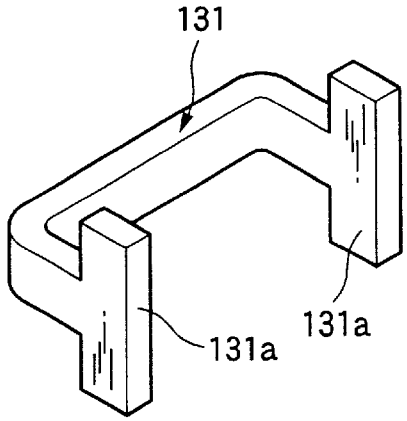
Figure 5D:
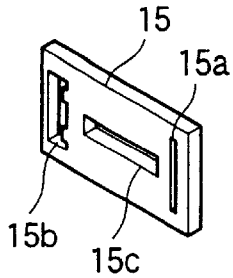
Figure 6A:
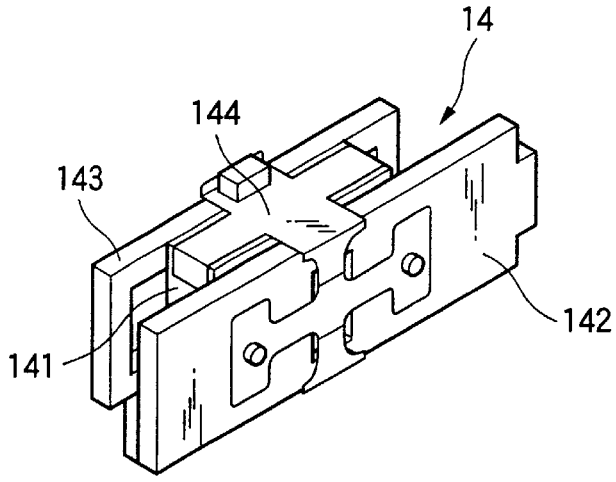
FIGS. 6(*a*) and 6(*b*) are exploded perspective views showing an armature block illustrated in FIG. 4, respectively.
Figure 6B:
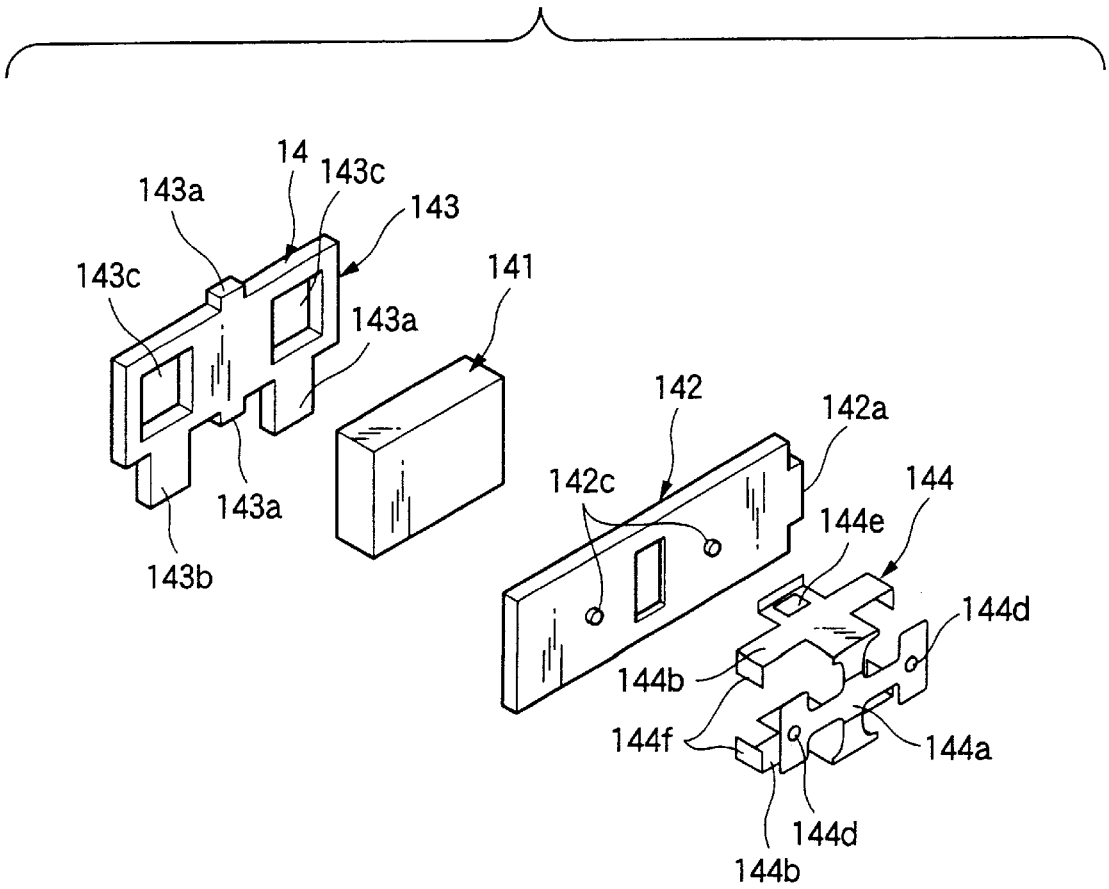
Figure 7B:
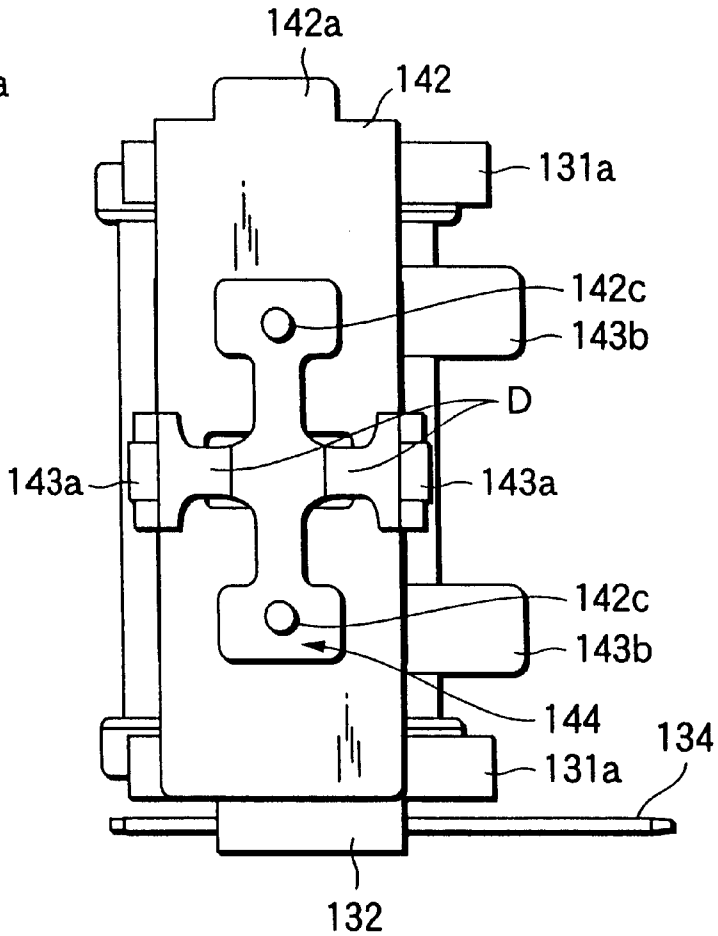
FIGS. 7(*a*) and 7(*b*) are views showing an electromagnet block and the armature block illustrated in FIG. 4 as seen from the front and the right, respectively.
Figure 7A:
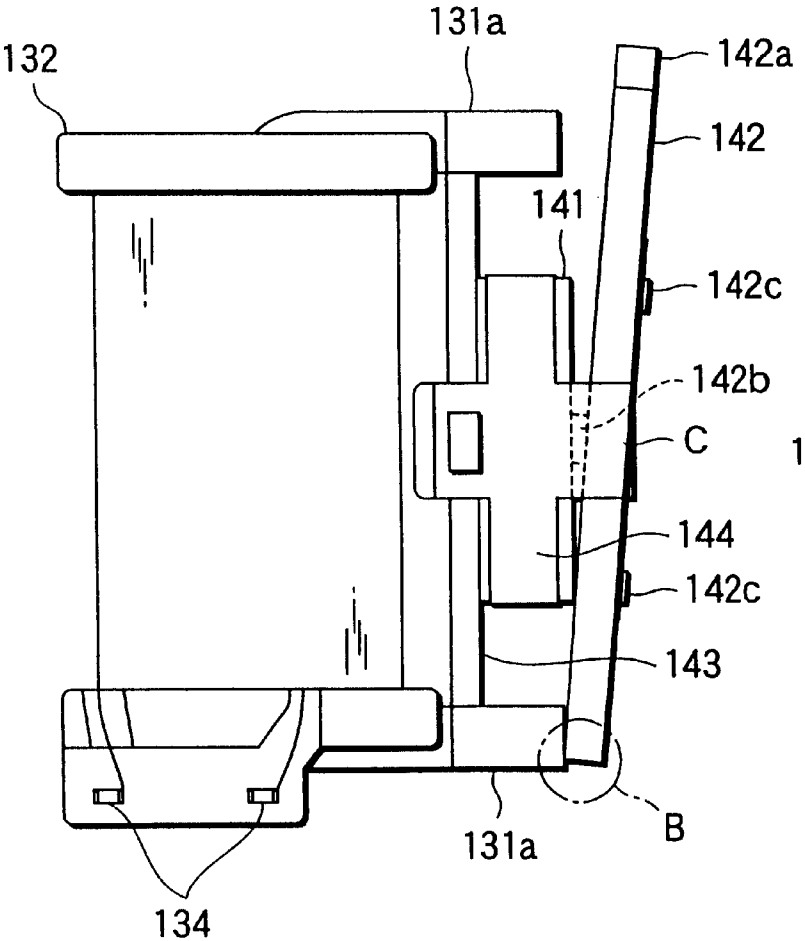
Figure 8B:
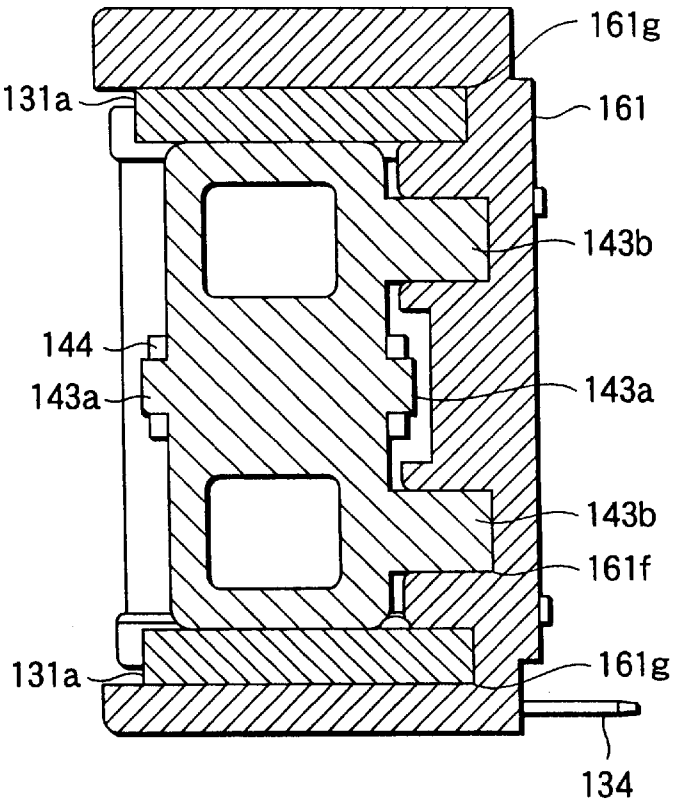
FIGS. 8(*a*) and 8(*b*) are a partial front view and a sectional view taken along the line A—A in FIG. 4, respectively.
Figure 8A:
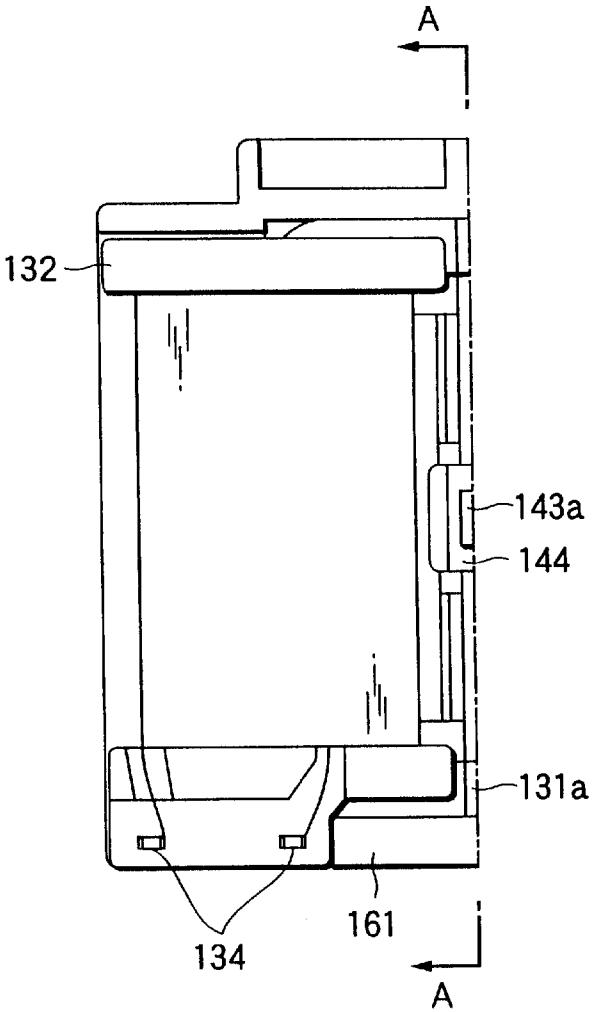

FIG. 4 is a perspective view showing an electromagnetic relay according to a first embodiment of the invention, which is partially taken away, FIG. 5 is a perspective view showing a fixed contact spring block, a moving contact spring block, a yoke and a card which are illustrated in FIG. 4, FIG. 6 is an exploded perspective view showing an armature block illustrated in FIG. 4, FIG. 7 is a view showing an electromagnet block and an armature block illustrated in FIG. 4 as seen from the front and the right, and FIG. 8 is a partial front view of FIG. 4 and a sectional view taken along the line A—A. With reference to these drawings, the first embodiment will be described below. In FIG. 7(*a*), B denotes a magnetic pole position and C denotes a center of rotation. In FIG. 7(*b*), D in a hinge spring denotes a twisted portion.

The electromagnetic relay shown in FIG. 4 belongs to a so-called latch type, and is roughly divided into a fixed contact spring block 11, a moving contact spring block 12, an electromagnet block 13, an armature block 14, a card 15 and a device body 16 for accommodating each part therein.

As shown in FIG. 5(*a*), the fixed contact spring block 11 is constituted by a fixed side terminal 111 formed by bending a metal plate, a leaf spring 112 made of metal which has a lower end fastened to the upper end of the fixed side terminal 111 through a rivet, and a fixed contact made of metal which is fastened to the upper portion of the leaf spring 112. The fixed contact is fastened to a cylindrical bottomed groove which is formed on the left surface (the back face in FIG. 5(*a*)) of the leaf spring 112 and has a contact portion protruded toward the left.

As shown in FIG. 5(*b*), the moving contact spring block 12 is constituted by a moving side terminal 121 made of a metal plate, a leaf spring 122 made of metal which has a lower end fastened to the upper end of the moving side terminal 121 through a rivet, and a moving contact 123 made of metal which is fastened to the upper portion of the leaf spring 122. A protruded piece 122*a* for attaching the card 15 is protruded upward from the upper end of the leaf spring 122.

As shown in FIG. 4, the electromagnet block 13 is constituted by a yoke 131 formed to take such a shape as to have both T-shaped ends 131*a* bent to the right (see FIG. 5(*c*)), a bobbin 132 made of a resin, a coil portion 133 having a coil wire wound onto a central portion between both ends 131*a* of the yoke 131 through the bobbin 132, and a pair of coil terminals 134 fastened integrally with the lower end side of the bobbin 132 to which both ends of the coil portion 133 are connected (through soldering, for example). Moreover, a groove (not shown) for inserting the yoke 131 is formed on the rear face side of the bobbin 132.

The procedure for manufacturing the electromagnet block 13 will be described. First of all, the yoke 131 is inserted in the groove of the bobbin 132 and the coil wire is wound onto the bobbin 132 to provide the coil portion 133. Subsequently, both ends of the coil portion 133 are connected to the coil terminals 134, respectively. Consequently, the electromagnet block 13 is obtained.

The armature block 14 is constituted by a permanent magnet 141, an armature 142, an auxiliary yoke 143 and a hinge spring 144 as shown in FIGS. 4 and 6.

The permanent magnet 141 is formed to take a plate shape (a rectangular parallelepiped in the example of FIG. 6(*b*)) having a smaller vertical length than that between both ends 131*a* of the yoke 131 and is provided such that the right face side is slightly protruded from both ends 131*a* of the yoke 131. Moreover, the permanent magnet 141 is polarized such that the right face side has an S pole and the left face side has an N pole or the right face side has the N pole and the left face side has the S pole before/after the assembly of the electromagnetic relay. For example, if the permanent magnet 141 is polarized after the assembly of the electromagnetic relay, it is possible to prevent iron powder from being stuck and mixed into the electromagnetic relay.

The armature 142 is formed like a plate to have a greater vertical length than that between both ends 131a of the yoke 131. As shown in FIG. 6(*b*), the armature 142 includes a protrusion 142*a* for attaching the card 15 protruded toward the upper end, a protrusion 142*b* protruded toward the center on the left face (see FIG. 7(*a*)), and a pair of shaft portions 142*c* protruded toward the upper and lower sides on the right face for rivet fastening, and is provided on the right side with respect to the permanent magnet 141 as shown in FIG. 7.

The auxiliary yoke 143 is formed like a plate to have a slightly smaller vertical length than that between the ends 131*a* of the yoke 131, includes a protrusion 143*a* serving to fix the hinge spring 144 and protruded toward the center of each of the front and rear side walls, a pair of protrusions 143*b* serving to fix the auxiliary yoke 143 to the device body 16 and protruded between both end sides of the rear side wall, and two holes 143*c* penetrating in a transverse direction, and is provided on the left side with respect to the permanent magnet 141 as shown in FIG. 7(*a*).

The hinge spring 144 has a central portion 144*a* which serves to fix the permanent magnet 141, the armature 142 and the auxiliary yoke 143 integrally, is formed of a thin metallic plate having elasticity, is formed like a cross extended in longitudinal and vertical directions and is attached to the right face of the armature 142, and both side portions 144*b* formed like a cross extended in vertical and horizontal directions, extended toward the left from the front and rear ends of the central portion 144*a* and attached to the front and rear side faces of the auxiliary yoke 143 as shown in FIG. 6(*b*). Moreover, a hole 144d in which the shaft portion 142*c* of the armature 142 is to be inserted is formed in each portion extended in the vertical direction of the central portion 144*a*. Furthermore, a hole 144*e* in which the protrusion 143*a* of the auxiliary yoke 143 is to be fitted is formed in a portion extended toward the left of each side portion 144*b*. In addition, a protruded piece 144*f* for preventing the vertical movement of the permanent magnet 141 is formed on the upper and lower ends of the side portion 144*b*.

The procedure for assembling the armature block 14 will be described. First of all, the corresponding shaft portion 142*c* of the armature 142 is inserted into the hole 144*d* of the hinge spring 144. Subsequently, the tip side of the shaft portion 142*c* is caulked. Consequently, the armature 142 and the hinge spring 144 are fastened to each other. Then, the permanent magnet 141 is interposed between both side portions 144*b* and the corresponding protrusion 143*a* of the auxiliary yoke 143 is thereafter fitted in the hole 144*e* of the hinge spring 144. Consequently, it is possible to obtain the armature block 14 having the permanent magnet 141, the armature 142 and the auxiliary yoke 143 fixed integrally with the hinge spring 144.

As shown in FIG. 5(*d*), the card 15 is formed of a resin like a plate, and has a hole 15*a* formed on the right end side for fitting the protruded piece 122*a* of the moving contact spring block 12 therein, a hole 15*b* formed on the left end side for fitting the protrusion 142*a* of the armature 142 therein, and a hole 15*c* extended in a transverse direction.

The device body 16 is constituted by a body 161 made of a resin and a cover 162 as shown in FIG. 4. The body 161 has partition walls 161*a* to 161*e* serving to accommodate and fix the fixed contact spring block 11 and the moving contact spring block 12 and protruded from the right side portion in a forward direction, a groove 161*f* in which each protrusion 143*b* of the auxiliary yoke 143 is to be fitted (see FIG. 5(*b*)), a groove 161*g* in which the lower end side of each end 131*a* of the yoke 131 is to be fitted (see FIG. 5(*b*)), a protrusion (not shown) which is inserted in the hole 15*c* of the card 15 to regulate the transverse movement of the card 15 and is protruded toward the upper face of the partition wall 161*e*, and a pair of holes (not shown) in which a pair of coil terminals 134 of the electromagnet block 13 are to be inserted. The grooves 161*f* and 161*g* for fitting are provided to have such shapes as to correspond to the outer shapes of the fitting portions of the protrusion 143*b* and the end 131*a* respectively, for example. Consequently, the relationship of arrangement between the electromagnet block 13 and the armature block 14 can be managed with predetermined precision. On the other hand, the cover 162 is formed to have the shape of a box for blocking the front face side of the body 161.

Next, description will be given to an example of the procedure for assembling the electromagnetic relay having such a structure. First of all, the fixed contact spring block 11 and the moving contact spring block 12 are accommodated and fixed into a predetermined position of the body 161. At this time, it is more desirable that an adhesive should be used.

Then, each protrusion 143*b* of the armature block 14 is fitted in the corresponding groove 161*f* of the body 161 to fix the armature block 14 to the body 161. At this time, it is more desirable that an adhesive should be used.

Thereafter, each coil terminal 134 of the electromagnet block 13 is inserted in the corresponding hole of the body 161. Subsequently, the lower end side of each end 131*a* of the yoke 131 is fitted in the corresponding groove 161*g* to fix the electromagnet block 13 to the body 161. At this time, it is more desirable that an adhesive should be used.

Then, the protruded piece 122*a* of the moving contact spring block 12 and the protrusion 142*a* of the armature 142 are fitted in the holes 15*a* and 15*b* of the card 15, respectively. Subsequently, the cover 162 is put and fixed onto the body 161. Thus, the electromagnetic relay is obtained.

In the electromagnetic relay thus assembled, the position of the armature 142 is determined by two points of the protrusion 142*b* and the position of a magnet pole (B in the example of FIG. 7(*a*)) as shown in FIG. 7(*a*). Therefore, an unnecessary clearance is not generated so that a magnetic gap is not caused. Consequently, a fluctuation in a magnetic characteristic is reduced so that a shock resistance can be enhanced. Moreover, a sensitivity can be regulated easily.

In addition to the integral structure of the armature block 14, furthermore, the protrusion 143*b* for fixing the armature block 14 to the body 161 is provided on the auxiliary yoke 143 as well as the function of a magnetic path for causing a magnetic flux to flow. Thus, the electromagnetic relay can be assembled easily.

Figure 9:
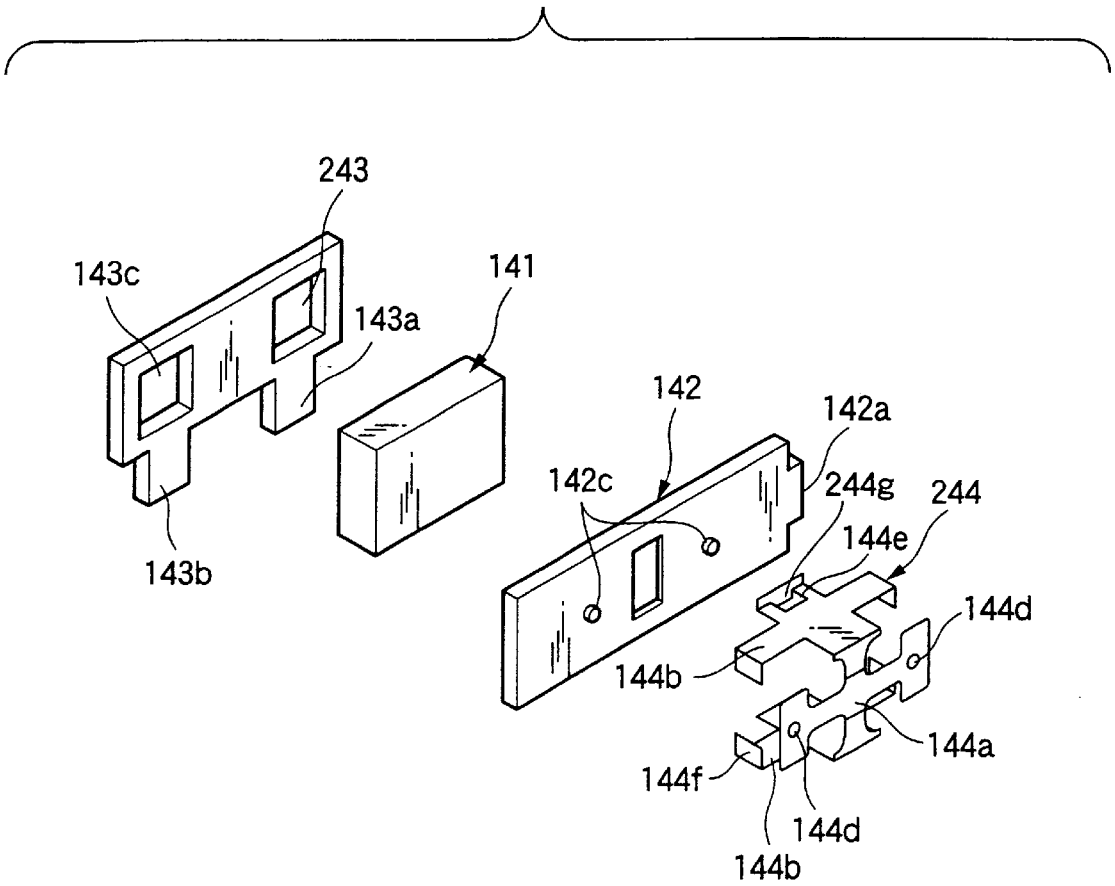
FIG. 9 is a view showing an example of another structure for fixing a hinge spring to an auxiliary yoke.

While a pair of protrusions 143*a* are provided on the auxiliary yoke 143 to attach the hinge spring to the auxiliary yoke in the first embodiment, it is also possible to employ another structure for attaching the hinge spring to the auxiliary yoke without the protrusion 143*a* provided, for example. An example of the structure is shown in FIG. 9. In FIG. 9, an auxiliary yoke 243 is formed to have the same shape as that of the auxiliary yoke 143 except that the protrusion 143*a* is removed. On the other hand, a hinge spring 244 is formed to have the same shape as that of the hinge spring 144 except that an engagement protrusion 244*g* with the auxiliary yoke 243 is formed on the left of the hole 144*e*.

Second Embodiment

Figure 10B:
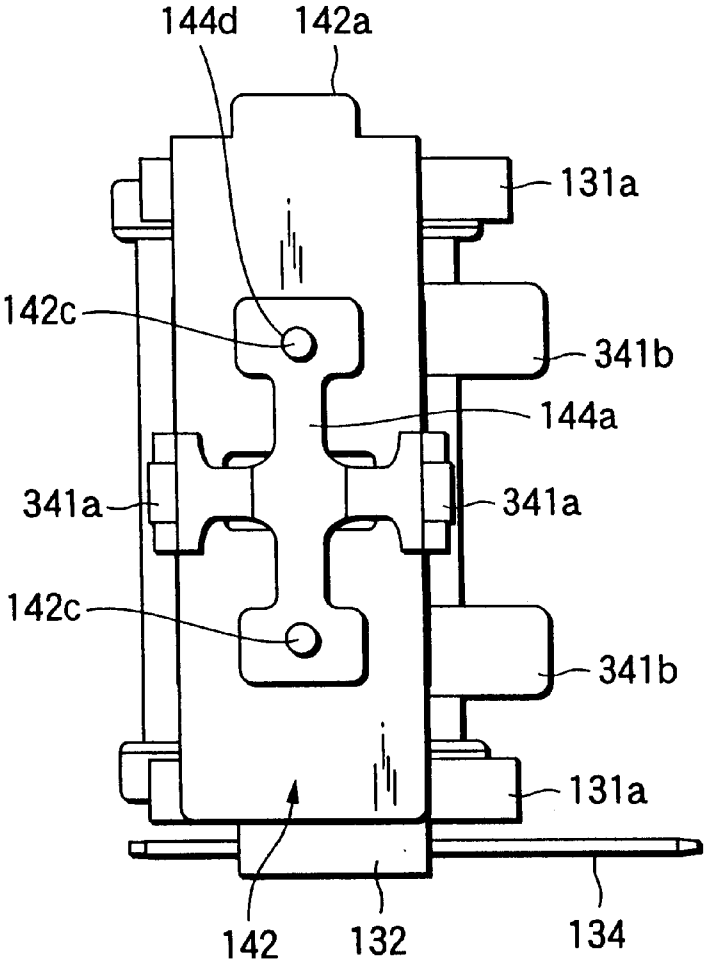
FIGS. 10(*a*) and 10(*b*) are views showing an electromagnet block and an armature block in an electromagnetic relay according to a second embodiment of the invention as seen from the front and the right, respectively.
Figure 10A:
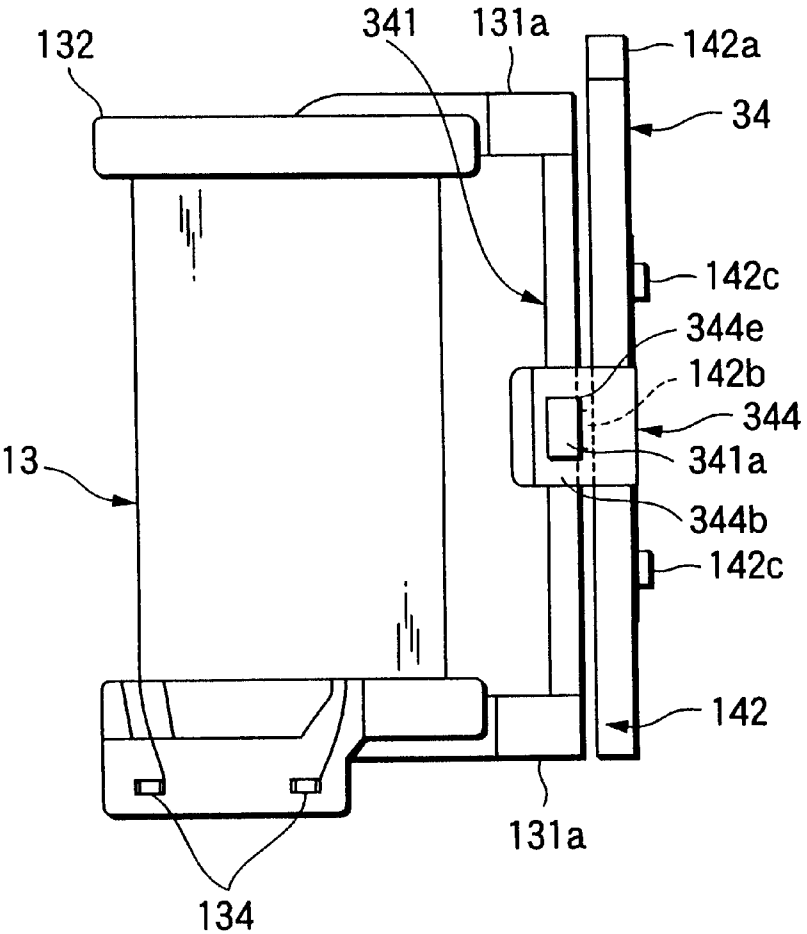

FIG. 10 is a view showing an electromagnet block and an armature block in an electromagnetic relay according to a second embodiment of the invention as seen from the front and the right. With reference to FIG. 10, the second embodiment will be described below.

The electromagnetic relay comprises a fixed contact spring block 11, a moving contact spring block 12, an electromagnet block 13, a card 15 and a device body 16 in almost the same manner as those in the first embodiment, and furthermore, comprises an armature block 34 differently from the first embodiment. Each groove 161*f* of a body 161 is provided in a position corresponding to a protrusion 341*b* of a permanent magnet 341 to be fitted in the groove 161*f*, which will be described below.

As shown in FIG. 10, the armature block 34 is constituted by the same armature 142 as that in the first embodiment and a permanent magnet 341 and a hinge spring 344 which are different from those in the first embodiment.

The permanent magnet 341 is formed like a plate to have a slightly smaller vertical length than that between the ends 131*a* of the yoke 131, and includes a protrusion 341*a* serving to fix the hinge spring 344 and protruded toward the center of each of the front and rear side walls, and a pair of protrusions 341*b* serving to fix the permanent magnet 341 to a body 161 of the device body 16 and protruded between both end sides of the rear side wall, and is provided such that a right face is on a level with the right end faces of both ends 131*a* of the yoke 131. Moreover, the permanent magnet 341 is polarized such that an upper end, a central portion and a lower end are set to have S, N and S poles or N, S and N poles before/after the assembly of the electromagnetic relay, respectively.

The hinge spring 344 serves to fix the permanent magnet 341 and the armature 142 integrally and is formed of a thin metallic plate having elasticity, and has a central portion 144*a* in the same manner as that in the first embodiment. In addition, the hinge spring 344 has both side portions 344*b* extended toward the left from the front and rear ends of the central portion 144*a* and attached to both side faces of the permanent magnet 341 in a longitudinal direction differently from the first embodiment. Moreover, each side portion 344*b* is provided with a hole 344*e* in which the protrusion 341*a* of the permanent magnet 341 is to be fitted.

The procedure for assembling the armature block 34 will be described. First of all, the corresponding shaft portion 142*c* of the armature 142 is inserted into the hole 144*d* of the hinge spring 344. Subsequently, the tip side of the shaft portion 142*c* is caulked. Consequently, the armature 142 and the hinge spring 344 are fastened to each other. Then, the corresponding protrusion 341*a* of the permanent magnet 341 is fitted in each hole 344*e* of the hinge spring 344. Thus, it is possible to obtain the armature block 34 having the permanent magnet 341 and the armature 142 fixed integrally with the hinge spring 344.

The electromagnetic relay having such a structure is assembled in the same procedure as that in the first embodiment. Also in the electromagnetic relay, moreover, the position of the armature 142 is determined by two points of the protrusion 142*b* and either of the positions of a magnet pole. Therefore, an unnecessary clearance is not generated so that a magnetic gap is not caused. Consequently, a fluctuation in a magnetic characteristic is reduced so that a shock resistance can be enhanced. Moreover, a sensitivity can be regulated easily.

Furthermore, an auxiliary yoke is not used. Therefore, the number of parts is decreased and a size can be reduced still more.

Third Embodiment

Figure 11B:
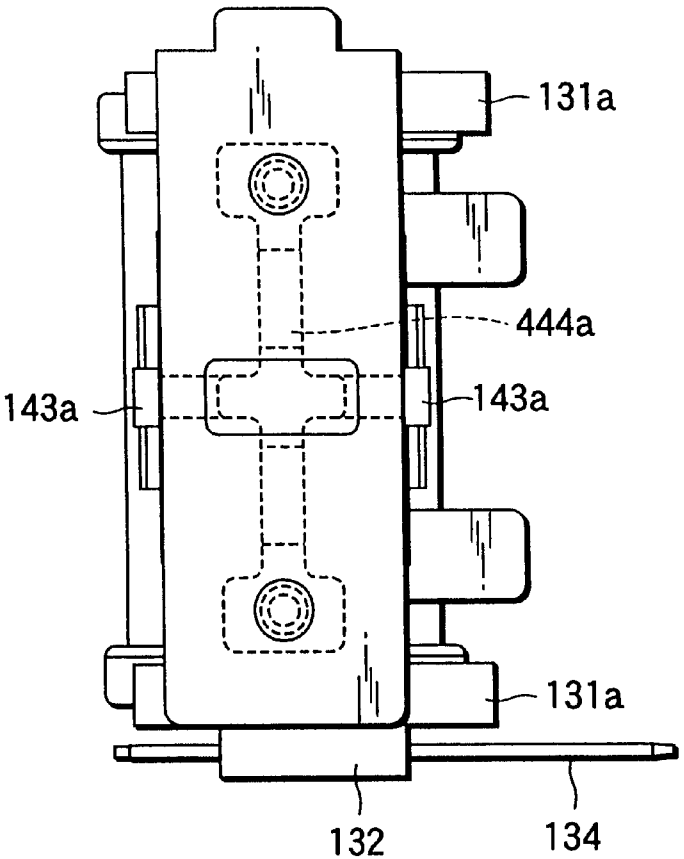
FIGS. 11(*a*) and 11(*b*) are views showing an electromagnet block and an armature block in an electromagnetic relay according to a third embodiment of the invention as seen from the front and the right, respectively.
Figure 11A:
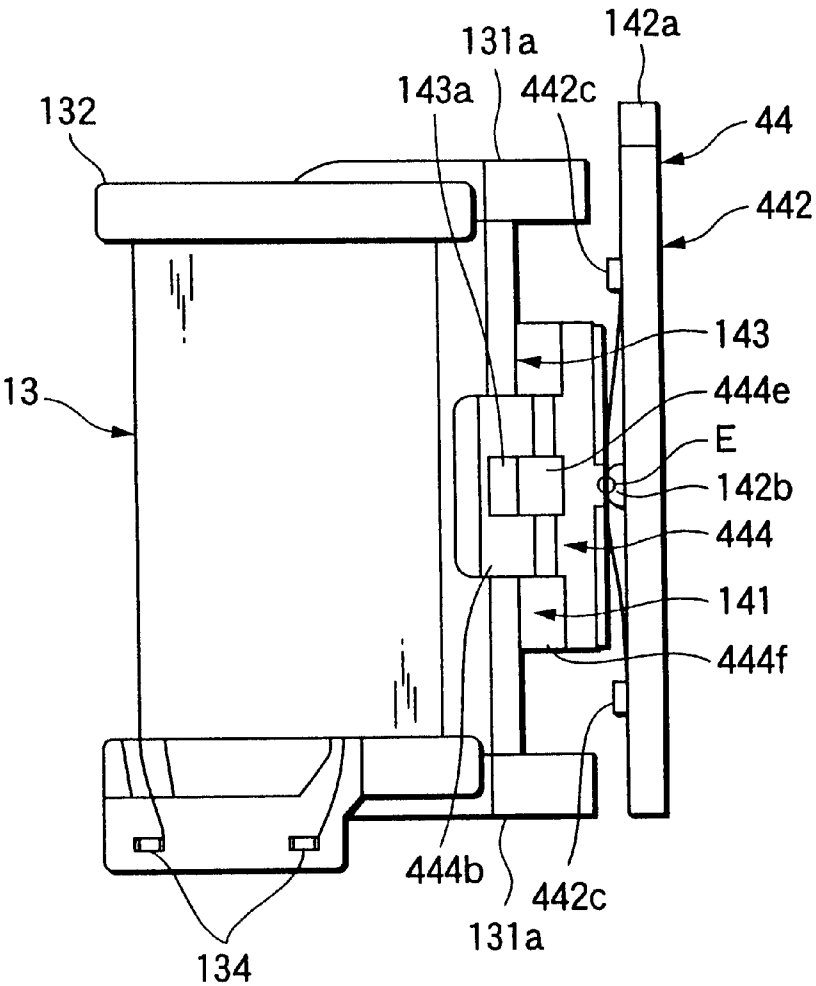
Figure 12A:
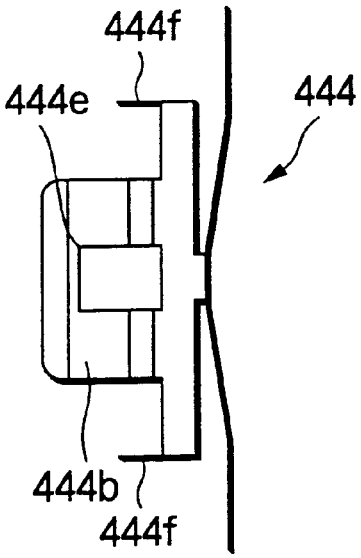
FIGS. 12(*a*) and 12(*b*) are views showing a hinge spring of FIG. 11 seen from the front and the right, respectively.
Figure 12B:
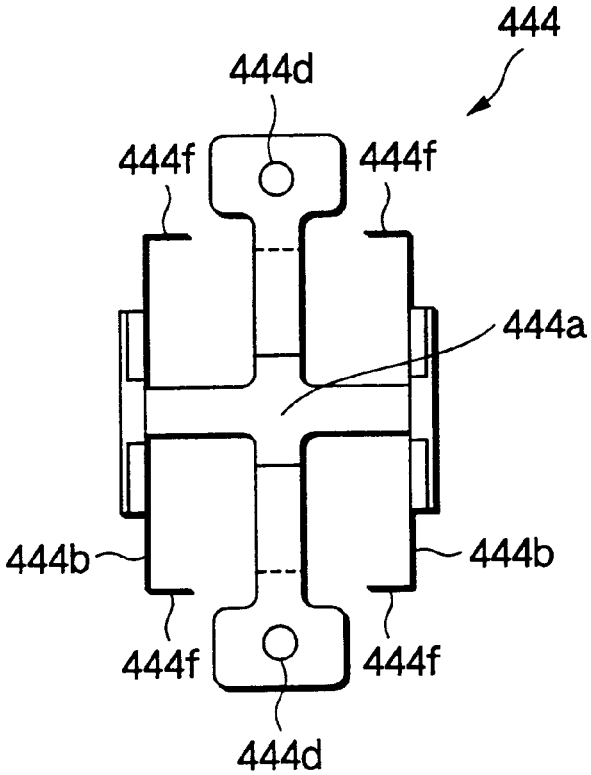

FIG. 11 is a view showing an electromagnet block and an armature block in an electromagnetic relay according to a third embodiment of the invention as seen from the front and the right, and FIG. 12 is a view showing a hinge spring of FIG. 11 see from the front and the right. With reference to these drawings, the third embodiment will be described below. In FIG. 11(*a*), E denotes a center of rotation.

The electromagnetic relay comprises a fixed contact spring block 11, a moving contact spring block 12, an electromagnet block 13, a card 15 and a device body 16 in the same manner as those in the first embodiment, and furthermore, an armature block 44 differently from the first embodiment.

As shown in FIG. 11, the armature block 44 is constituted by the same permanent magnet 141 and auxiliary yoke 143 as those in the first embodiment and an armature 442 and a hinge spring 444 differently from those in the first embodiment.

The armature 442 is formed like a plate having a greater vertical length than that between both ends 131*a* of a yoke 131 and has protrusions 142*a* and 142*b* in the same manner as those in the first embodiment. In addition, the armature 442 has a pair of shaft portions 442*c* for rivet fastening which are protruded toward the upper and lower sides on the left face differently from the first embodiment, and is provided on the right side with respect to the permanent magnet 141.

The hinge spring 444 has a central portion 444*a* which serves to fix the permanent magnet 141, the armature 442 and the auxiliary yoke 143 integrally, is formed of a thin metallic plate having elasticity, is formed like a cross extended in longitudinal and vertical directions and is attached to the left face of the armature 442, and both side T-shaped portions 444*b* extended toward the left from the front and rear ends of the central portion 444*a* and attached to the front and rear side faces of the auxiliary yoke 143 as shown in FIG. 12. Moreover, a hole 444*d* in which the shaft portion 442*c* of the armature 442 is to be inserted is formed in each portion extended in the vertical direction of the central portion 444*a*. Furthermore, a hole 444*e* in which the protrusion 143*a* of the auxiliary yoke 143 is to be fitted is formed in each side portion 444*b*. In addition, a protruded piece 444*f* for preventing the vertical movement of the permanent magnet 141 is formed on the upper and lower ends of the side portion 444*b*.

The procedure for assembling the armature block 44 will be described. First of all, the corresponding shaft portion 442*c* of the armature 442 is inserted into the hole 444*d* of the hinge spring 444. Subsequently, the tip side of the shaft portion 442*c* is caulked. Consequently, the armature 442 and the hinge spring 444 are fastened to each other. Then, the permanent magnet 141 is interposed between both side portions 444*b* and the corresponding protrusion 143*a* of the auxiliary yoke 143 is thereafter fitted in the hole 444*e* of the hinge spring 444. Consequently, it is possible to obtain the armature block 44 having the permanent magnet 141, the armature 442 and the auxiliary yoke 143 fixed integrally with the hinge spring 444.

The electromagnetic relay having such a structure is assembled in the same procedure as that in the first embodiment. Also in the electromagnetic relay, moreover, the position of the armature 442 is determined by two points of the protrusion 142*b* and either of the positions of a magnet pole. Therefore, an unnecessary clearance is not generated so that a magnetic gap is not caused. Consequently, a fluctuation in a magnetic characteristic is reduced so that a shock resistance can be enhanced. Moreover, a sensitivity can be regulated easily.

Furthermore, it is possible to suitably prevent wear from being caused by the toggle motion of the armature block 44. In the first embodiment, the hinge spring 144 is twisted in the twisted portion D as shown in FIG. 7. Consequently, the rotational motion of the armature 142 is generated. However, since the center C of rotation is shifted from the protrusion 142*b* in the height direction (transverse direction), the protrusion 142*b* of the armature 142 carries out a toggle motion on the permanent magnet 141. Therefore, a great friction is caused between the protrusion 142*b* of the armature 142 and the permanent magnet 141 so that both of them are worn easily. On the other hand, in the third embodiment, the center E of rotation of the armature 442 is rarely shifted from the protrusion 142*b* of the armature 442 in the height direction as shown in FIG. 11. Therefore, the protrusion 142*b* of the armature 442 carries out a rolling motion on the hinge spring 444 or the permanent magnet 141. Consequently, smaller frictional force is generated between the protrusion 142*b* of the armature 442 and the hinge spring 444 or permanent magnet 141 so that their wear can be prevented.

Fourth Embodiment

Figure 13A:
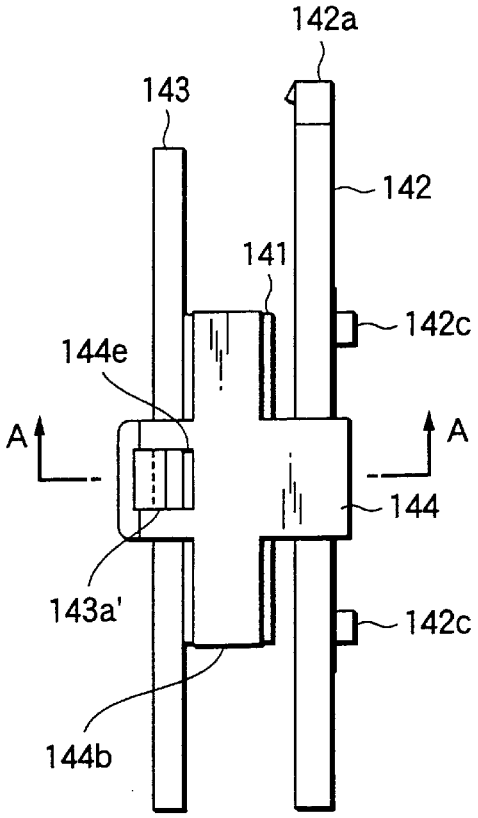
FIGS. 13*a–c* are views showing an armature block of an electromagnetic relay according to a fourth embodiment of the invention.
Figure 13B:
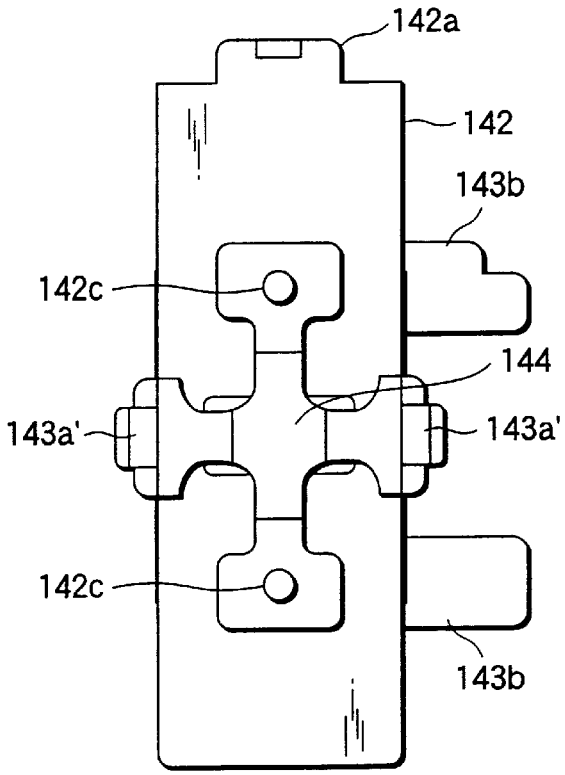
Figure 13C:
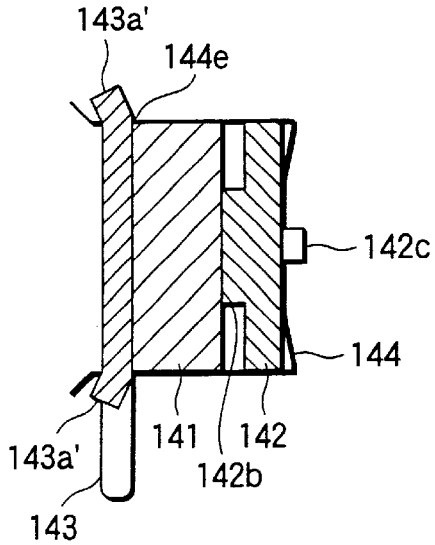
Figure 14A:
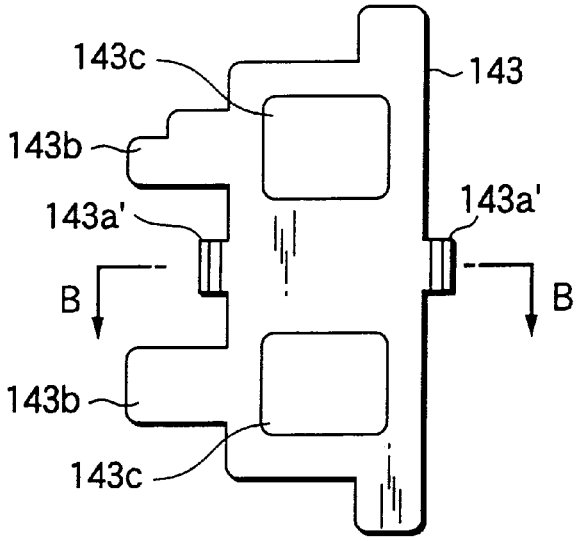
FIGS. 14*a–c* are views showing an auxiliary yoke of the electromagnetic relay according to the fourth embodiment.
Figure 14B:
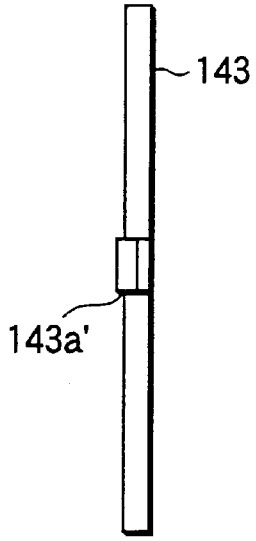
Figure 14C:
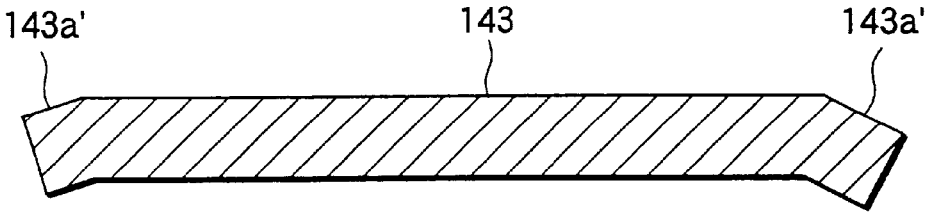

FIG. 13 is a view showing an armature block of an electromagnetic relay according to a fourth embodiment of the present invention, and FIG. 14 is a view showing an auxiliary yoke of the electromagnetic relay according to the fourth embodiment. With reference to these drawings, the fourth embodiment will be described below. FIGS. 13(*a*) and 13(*b*) are views showing the armature block seen from the front and the right respectively, and FIG. 13(*c*) is a sectional view taken along the line A—A of FIG. 13(*a*). FIGS. 14(*a*) and 14(*b*) are views showing the auxiliary yoke seen from the left and the front respectively, and FIG. 14(*c*) is a sectional view taken along the line B—B of FIG. 14(*a*).

The electromagnetic relay according to the fourth embodiment is constituted by a fixed contact spring block 11, a moving contact spring block 12, an electromagnet block 13, an armature block 14, a card 15 and a device body 16 for accommodating these parts therein in the same manner as the electromagnetic relay described with reference to FIGS. 4 to 9 except that an auxiliary yoke 143 has a concavo-convex disengagement prevention structure.

More specifically, a hinge spring 144 has a hole 144*e* formed on each of both ends 144*b*, and the auxiliary yoke 143 has a protrusion 143*a*' to be fitted in each of the holes 144*e* formed on both ends 144*b*. The electromagnetic relay is different from the electromagnetic relay described with reference to FIGS. 4 to 9 in that the protrusion 143*a*' is bent to the left as the disengagement prevention structure.

With such a disengagement prevention structure, the protrusion 143*a*' bent to the left engages the peripheral portion of the hole 144*e* of the hinge spring 144 as shown in FIG. 14(*c*) even if a longitudinal vibration or impact is applied to the electromagnetic relay. Therefore, the protrusion 143*a*' slips off from the hole 144*e* of the hinge spring 144 with difficulty. Consequently, it is possible to provide an electromagnetic relay which changes a characteristic with difficulty even if the vibration or impact is applied.

Fifth Embodiment

Figure 15A:
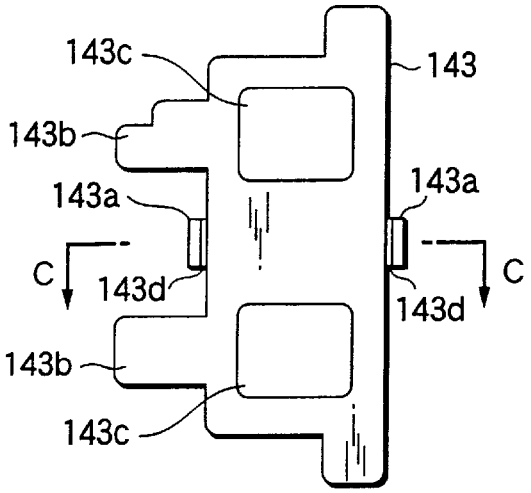
FIGS. 15*a–c* are views showing an auxiliary yoke of an electromagnetic relay according to a fifth embodiment of the invention.
Figure 15B:
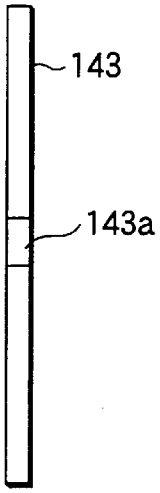
Figure 15C:
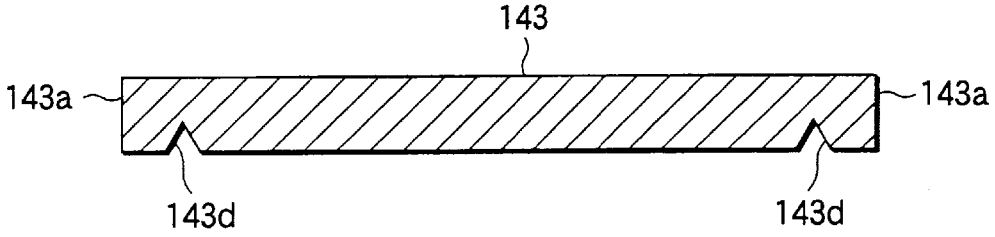
Figure 16A:
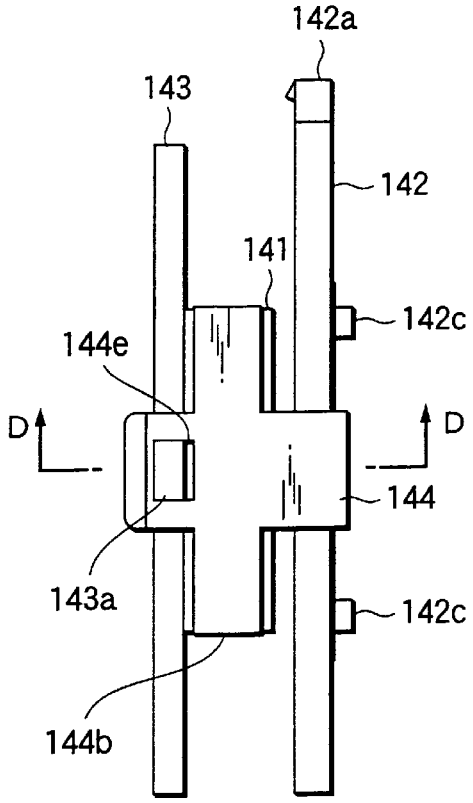
FIGS. 16*a–c* are views showing an armature block of the electromagnetic relay according to the fifth embodiment.
Figure 16B:
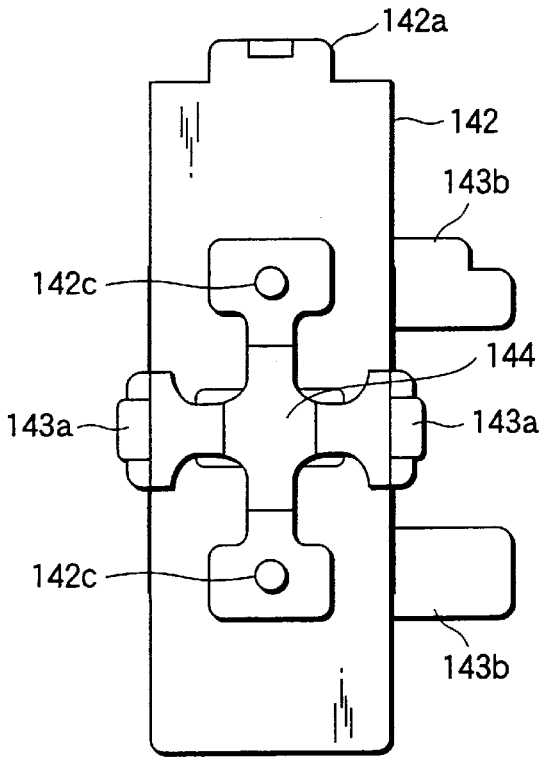
Figure 16C:
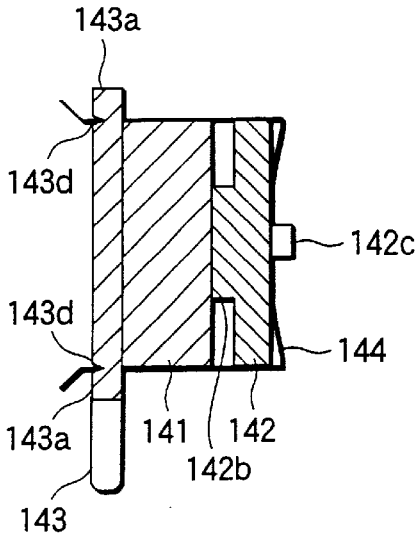

FIG. 15 is a view showing an auxiliary yoke of an electromagnetic relay according to a fifth embodiment of the invention, and FIG. 4 is a view showing an armature block of the electromagnetic relay according to the second embodiment. With reference to these drawings, the fifth embodiment will be described below. FIGS. 15(*a*) and 15(*b*) are views showing the auxiliary yoke seen from the left and the front respectively, and FIG. 15(*c*) is a sectional view taken along the line C—C of FIG. 15(*a*). FIGS. 16(*a*) and 16(*b*) are views showing the armature block seen from the front and the right respectively, and FIG. 16(*c*) is a sectional view taken along the line D—D of FIG. 16(*a*).

The electromagnetic relay according to the fifth embodiment is constituted by a fixed contact spring block 11, a moving contact spring block 12, an electromagnet block 13, an armature block 14, a card 15 and a device body 16 for accommodating these parts therein in the same manner as the electromagnetic relay described with reference to FIGS. 4 to 9 except that an auxiliary yoke 143 has a concavo-convex disengagement prevention structure.

More specifically, a hinge spring 144 has a hole 144*e* formed on each of both ends 144*b*, and the auxiliary yoke 143 has a protrusion 143*a* to be fitted in each of the holes 144*e* formed on both ends 144*b*. The electromagnetic relay is different from the electromagnetic relay described with reference to FIGS. 4 to 9 in that the protrusion 143*a* has a V-shaped groove 143*d* for fitting the peripheral portion of the corresponding hole 144*e* of the ends 144*b* provided on the left surface as the disengagement prevention structure.

With such a disengagement prevention structure, the peripheral portion of the corresponding hole 144*e* is fitted in the V-shaped groove 143*d* as shown in FIG. 16(*c*) even if a longitudinal vibration or impact is applied to the electromagnetic relay. Therefore, the protrusion 143*a* slips off from the hole 144*e* of the hinge spring 144 with difficulty. Consequently, it is possible to provide an electromagnetic relay which changes a characteristic with difficulty even if the vibration or impact is applied. Moreover, since the V-shaped groove 143*d* has a greater angle of a slant face than that of the protrusion 143*a*' according to the fourth embodiment, it is possible to expect the disengagement prevention effect which is more suitable than that of the fourth embodiment.

Sixth Embodiment

Figure 17A:
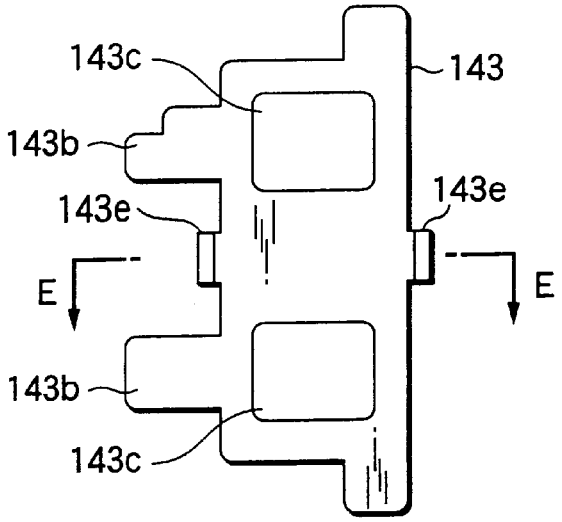
FIGS. 17*a–c* are views showing an auxiliary yoke of an electromagnetic relay according to a sixth embodiment of the invention.
Figure 17B:
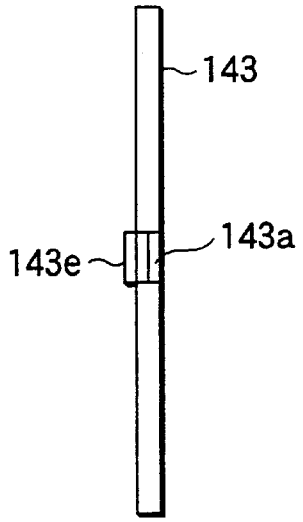
Figure 17C:
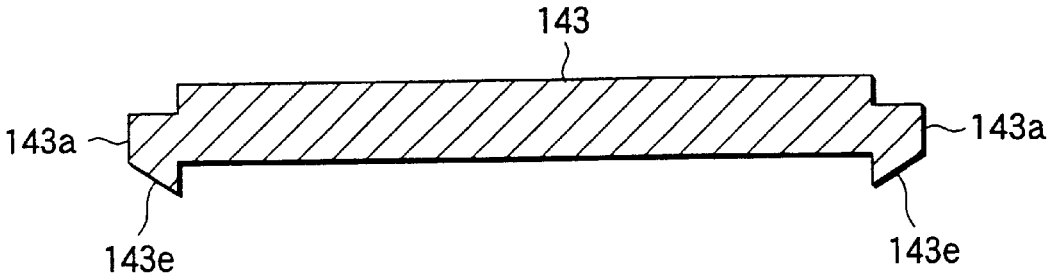
Figure 18A:
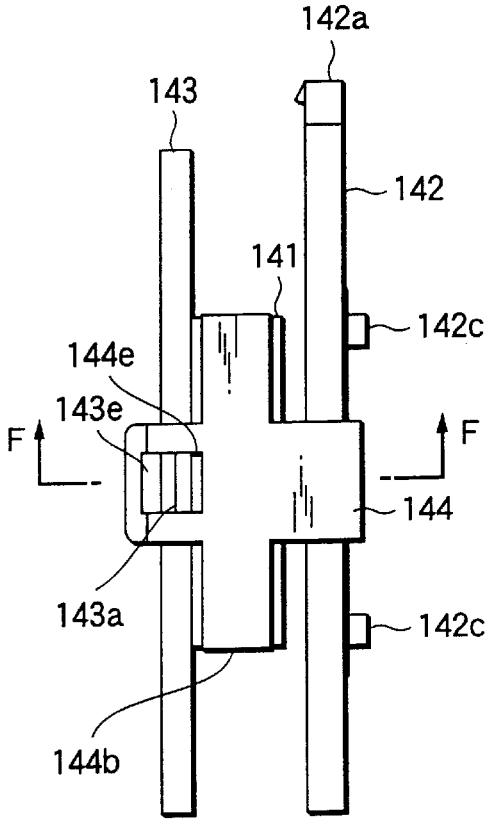
FIGS. 18*a–c* are views showing an armature block of the electromagnetic relay according to the sixth embodiment.
Figure 18B:
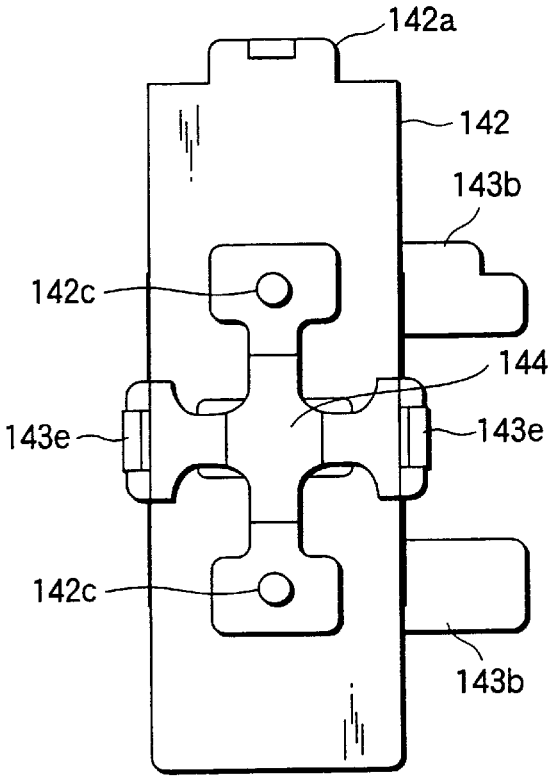
Figure 18C:
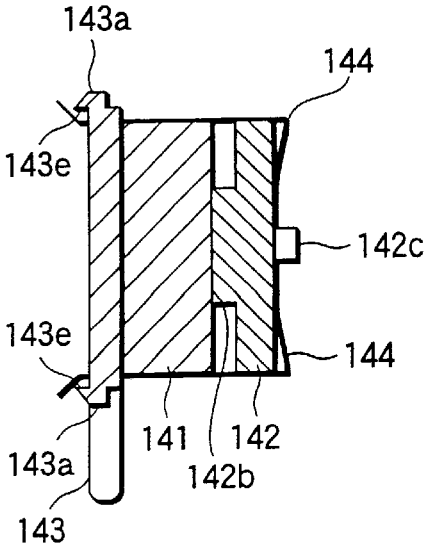

FIG. 17 is a view showing an auxiliary yoke of an electromagnetic relay according to a sixth embodiment of the invention, and FIG. 18 is a view showing an armature block of the electromagnetic relay according to the six embodiment. With reference to these drawings, the sixth embodiment will be described below. FIGS. 17(*a*) and 17(*b*) are views showing the auxiliary yoke seen from the left and the front respectively, and FIG. 17(*c*) is a sectional view taken along the line E—E of FIG. 17(*a*). FIGS. 18(*a*) and 18(*b*) are views showing the armature block seen from the front and the right respectively, and FIG. 18(*c*) is a sectional view taken along the line F—F of FIG. 18(*a*).

The electromagnetic relay according to the six embodiment is constituted by a fixed contact spring block 11, a moving contact spring block 12, an electromagnet block 13, an armature block 14, a card 15 and a device body 16 for accommodating these parts therein in the same manner as the electromagnetic relay described with reference to FIGS. 4 to 9 except that an auxiliary yoke 143 has a concavo-convex disengagement prevention structure.

More specifically, a hinge spring 144 has a hole 144*e* formed on each of both ends 144*b*, and the auxiliary yoke 143 has a protrusion 143*a* to be fitted in each of the holes 144*e* formed on both ends 144*b*. The electromagnetic relay is different from the electromagnetic relay described with reference to FIGS. 4 to 9 in that the protrusion 143*a* has a hook-shaped click portion 143*e* extended to the left as the disengagement prevention structure.

With such an disengagement prevention structure, the click portion 143*e* provided on each protrusion 143*a* engages the peripheral portion of the hole 144*e* of the hinge spring 144 as shown in FIG. 18(*c*) even if a longitudinal vibration or impact is applied to the electromagnetic relay. Therefore, the protrusion 143*a* slips off from the hole 144*e* of the hinge spring 144 with difficulty. Consequently, it is possible to provide an electromagnetic relay which changes a characteristic with difficulty even if the vibration or impact is applied.

Seventh Embodiment

The electromagnetic relay comprises an electromagnet block 13, a card 15 and a device body 16 in the same manner as those in the first embodiment, and furthermore, a fixed contact spring block 11', a moving contact spring block 12' differently from the first embodiment.

The reference numeral 121' denotes a movable terminal formed of a metal material to be plate-shaped. A base end of a movable spring 122' which will be described below is caulked and fixed to the tip portion in the longitudinal direction. The movable terminal 121' has an arm-shaped pressing portion 8*a* extended from one of sides of the tip portion in the longitudinal direction such that it is positioned in the vicinity of the movable spring 122'. A tip portion of the pressing portion 8*a* can press the movable spring 122' to be elastically deformed in a direction of displacement. The pressing portion 8*a* is almost arcuate such that a middle potion keeps away from the movable spring 122' and a pressing face of the tip portion for pressing the movable spring 122' is curved.

The reference numeral 122' denotes a movable spring formed of a metal material like an almost rectangular thin plate. The movable spring 122' has a base end caulked and fixed to the tip portion of the movable terminal 121' and constitutes a movable terminal block 12' together with the movable terminal 121'. A tip of the movable spring 122' is provided with an insertion portion 122*a*' to be inserted in an insertion hole 15*a* of a card 15 which will be described below, and a moving contact 123' is caulked into a tip portion slightly closer to a central part than the tip.

Figure 20:
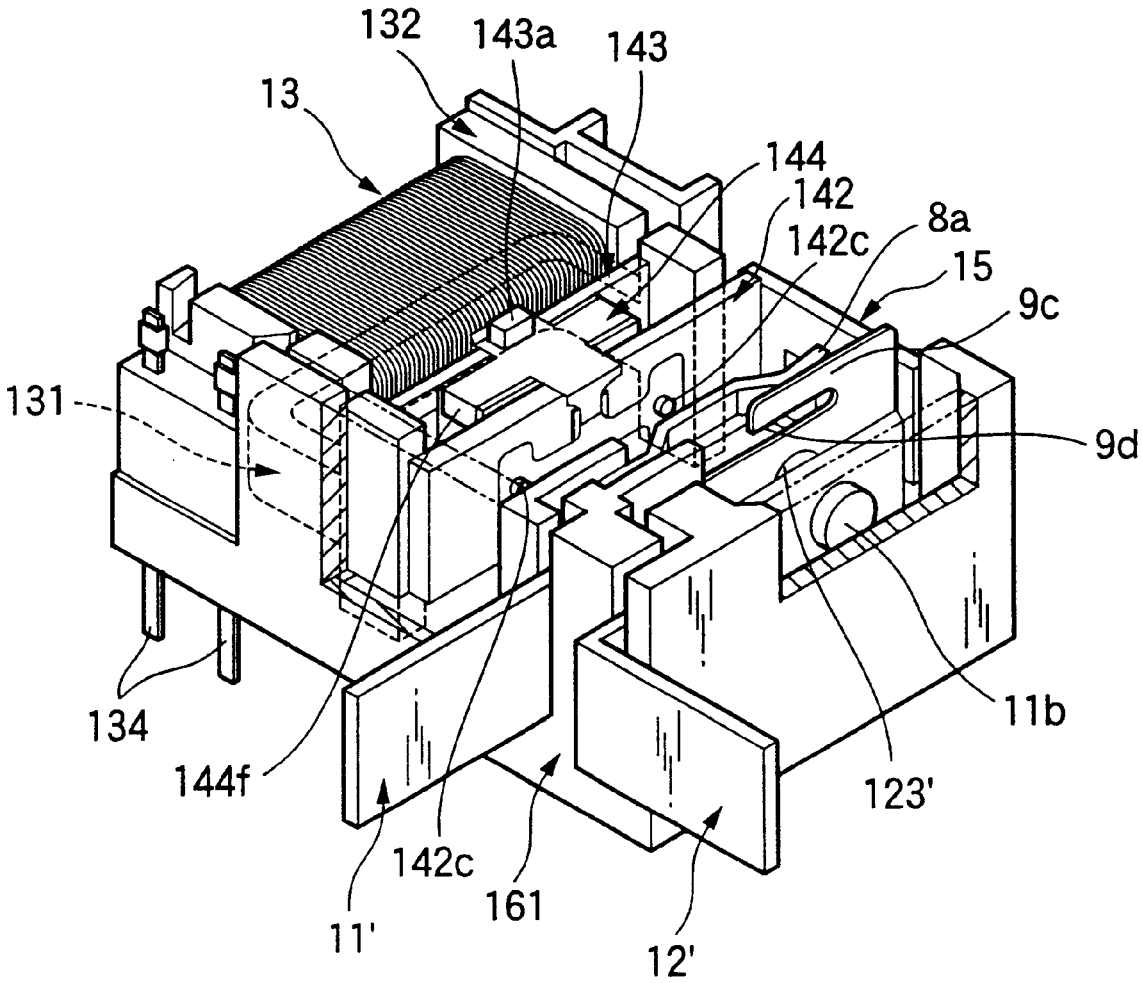
FIG. 20 is a perspective view showing the contact separating state.
Figure 21:
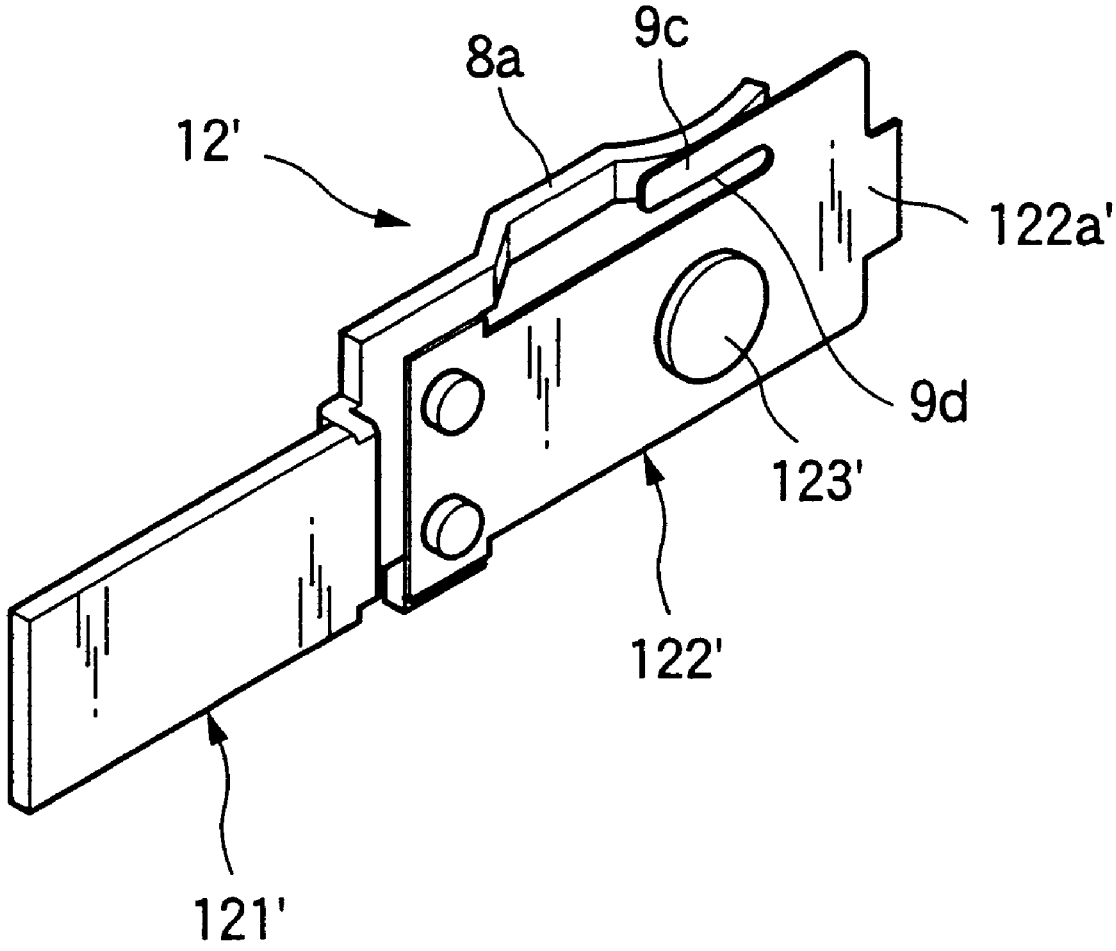
FIG. 21 is a perspective view showing a moving terminal block according to the embodiment of the invention.
Figure 22:
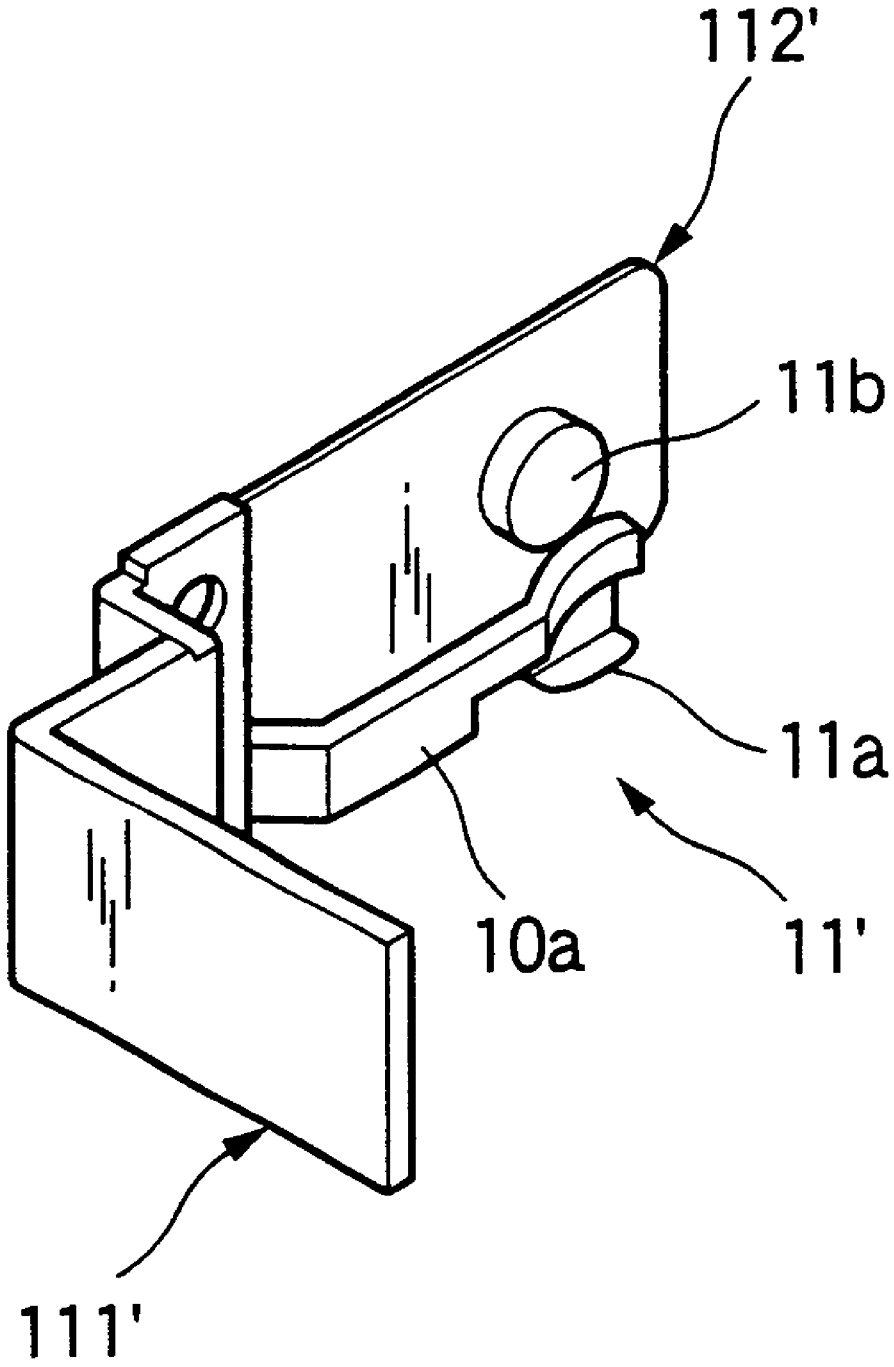
FIG. 22 is a perspective view showing a fixed terminal block according to the embodiment of the invention.
Figure 23:
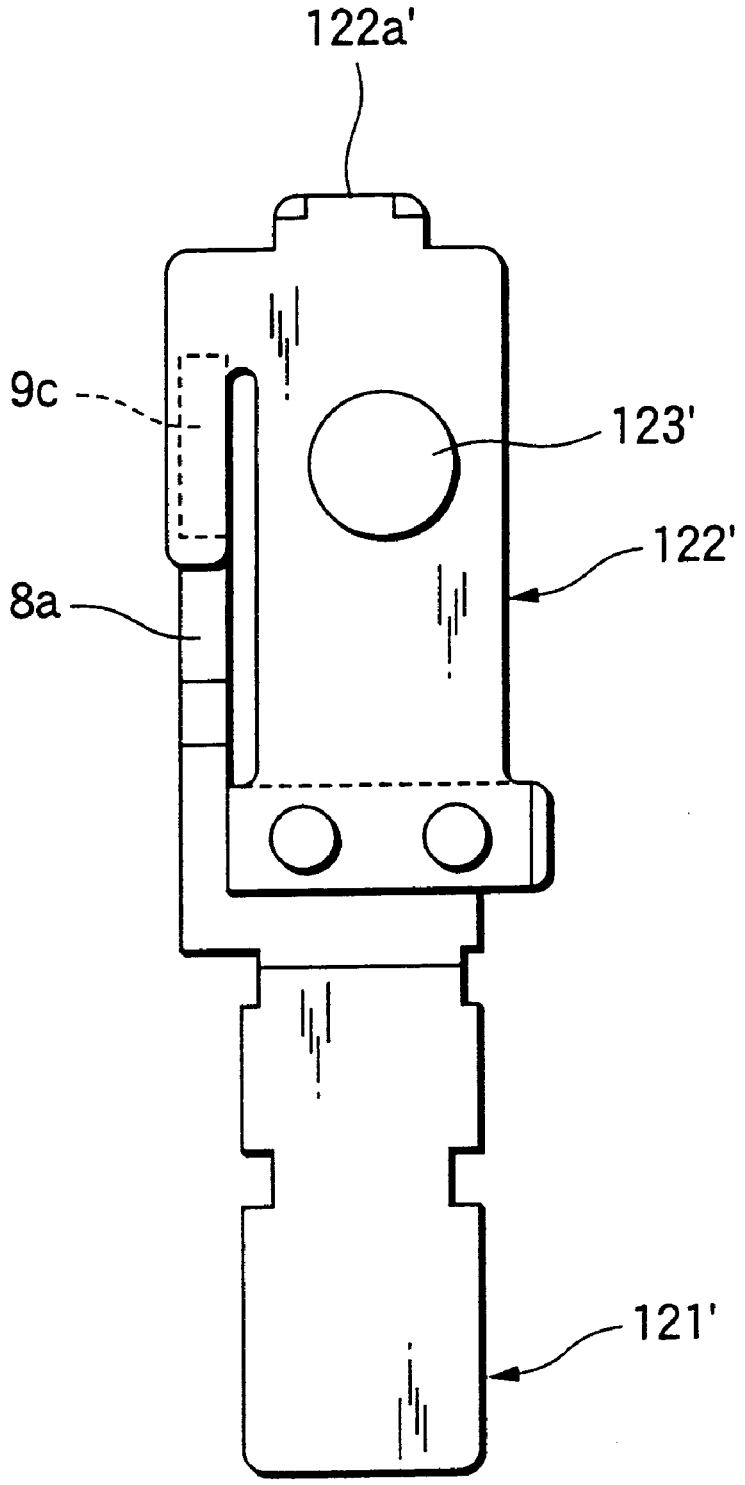
FIG. 23 is a front view showing the moving terminal block according to the embodiment of the invention.
Figure 24:
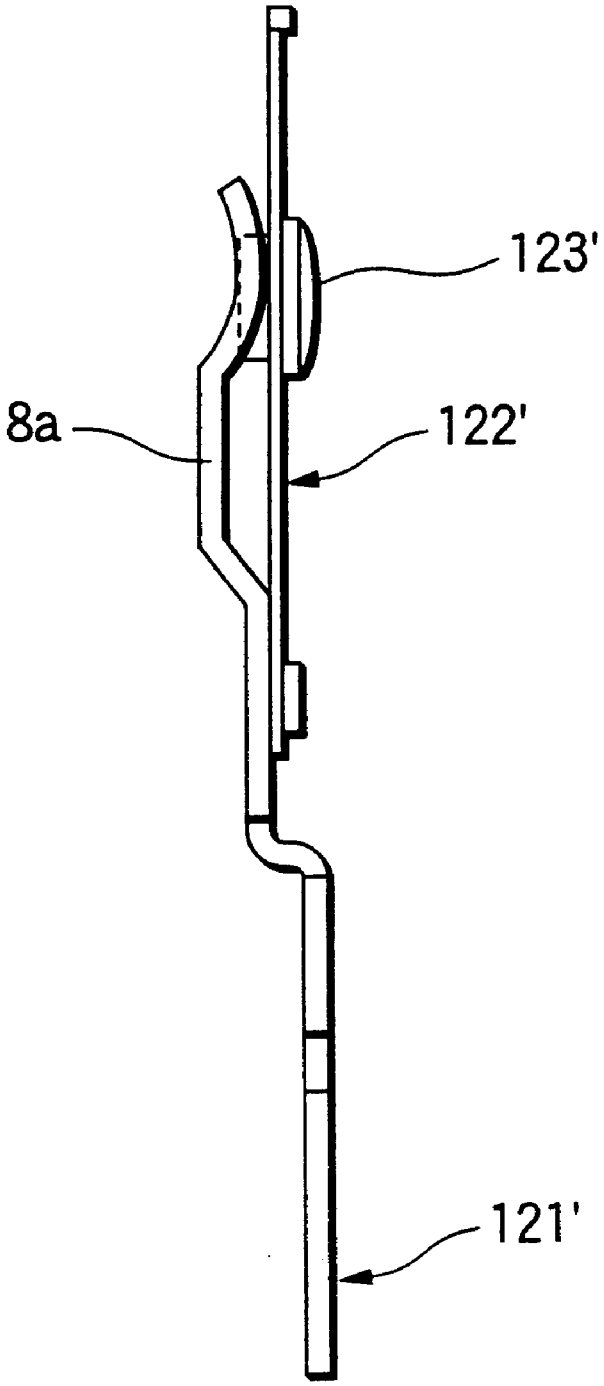
FIG. 24 is a side view showing the moving terminal block according to the embodiment of the invention.
Figure 25:
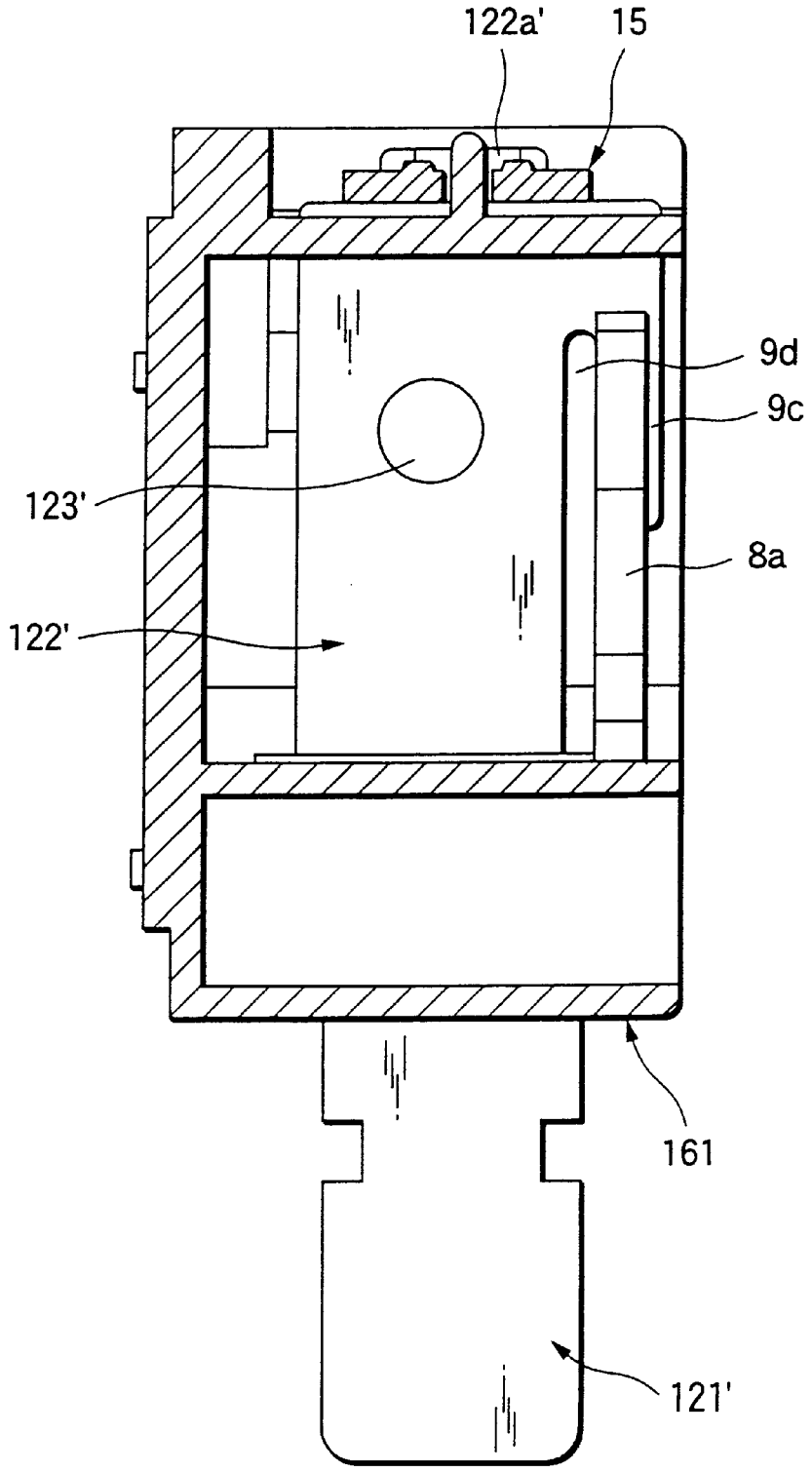
FIG. 25 is a sectional view taken along the line X—X in FIG. 19.

One of sides which is close to the moving contact 123' of the movable spring 122' acts as a pressed portion 9*c* capable of being pressed by the pressing portion 8*a* of the movable terminal 121'. A slit-shaped cut portion 9*d* is provided between the pressed portion 9*c* and the moving contact 123'. The cut portion 9*d* causes the spring force of the pressed portion 9*c* to be locally reduced. Furthermore, when the pressed portion 9*c* is raised and bent, it is elastically deformed in the direction of the displacement of the movable spring 122'. The pressed portion 9*c* of the movable spring 122' is placed in the outermost position together with the pressing portion 8*a* of the movable terminal 121' as shown in FIG. 20 in a state in which the movable terminal block 12' is provided on a body 161 to be described below.

The reference numeral 111' denotes a fixed terminal formed of a metal material to be plate-shaped. A base end of a fixed contact plate 112' which will be described below is caulked and fixed into a tip portion in a longitudinal direction. The fixed terminal 111' has a contact portion 10*a* from one of sides of the tip portion in the longitudinal direction such that the tip portion is positioned in the vicinity of a fixed contact 11*b* of the fixed contact plate 11 in the same manner as the movable terminal 121' having the arm-shaped pressing portion 8*a* extended. The contact portion 10*a* has a tip portion in contact with the fixed contact plate 112'. The contact portion 10*a* has the same shape as that of the pressing portion 8*a*, that is, an almost arcuate arm shape to cause a middle portion to be kept away from the fixed contact plate 112', and a contact face of the tip portion coming in contact with the vicinity of the fixed contact 11*b* of the fixed contact plate 112' is curved.

Figure 26A:
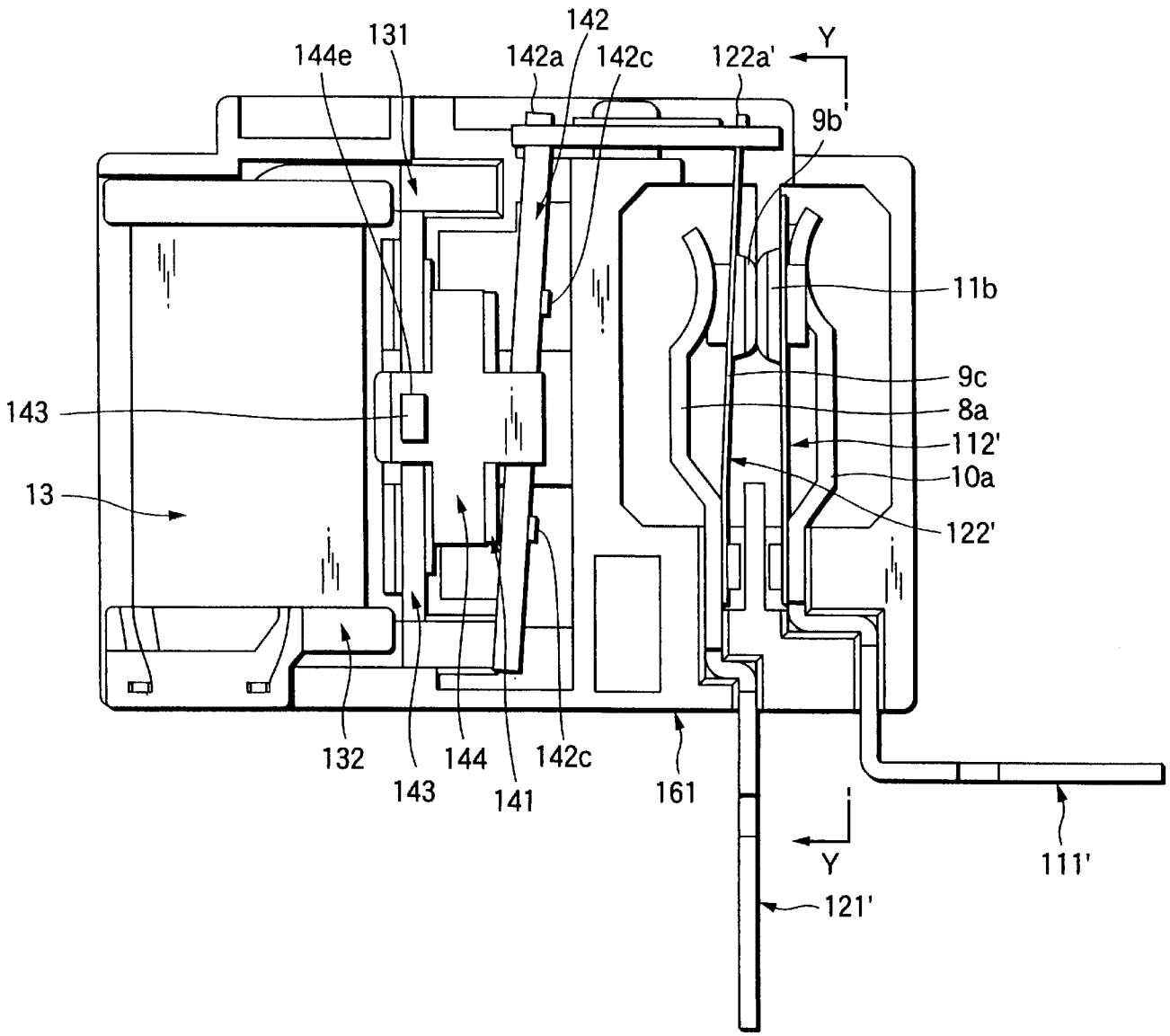
FIG. 26(*a*) is a side view showing a contact abutting state according to the embodiment of the invention.
Figure 26B:
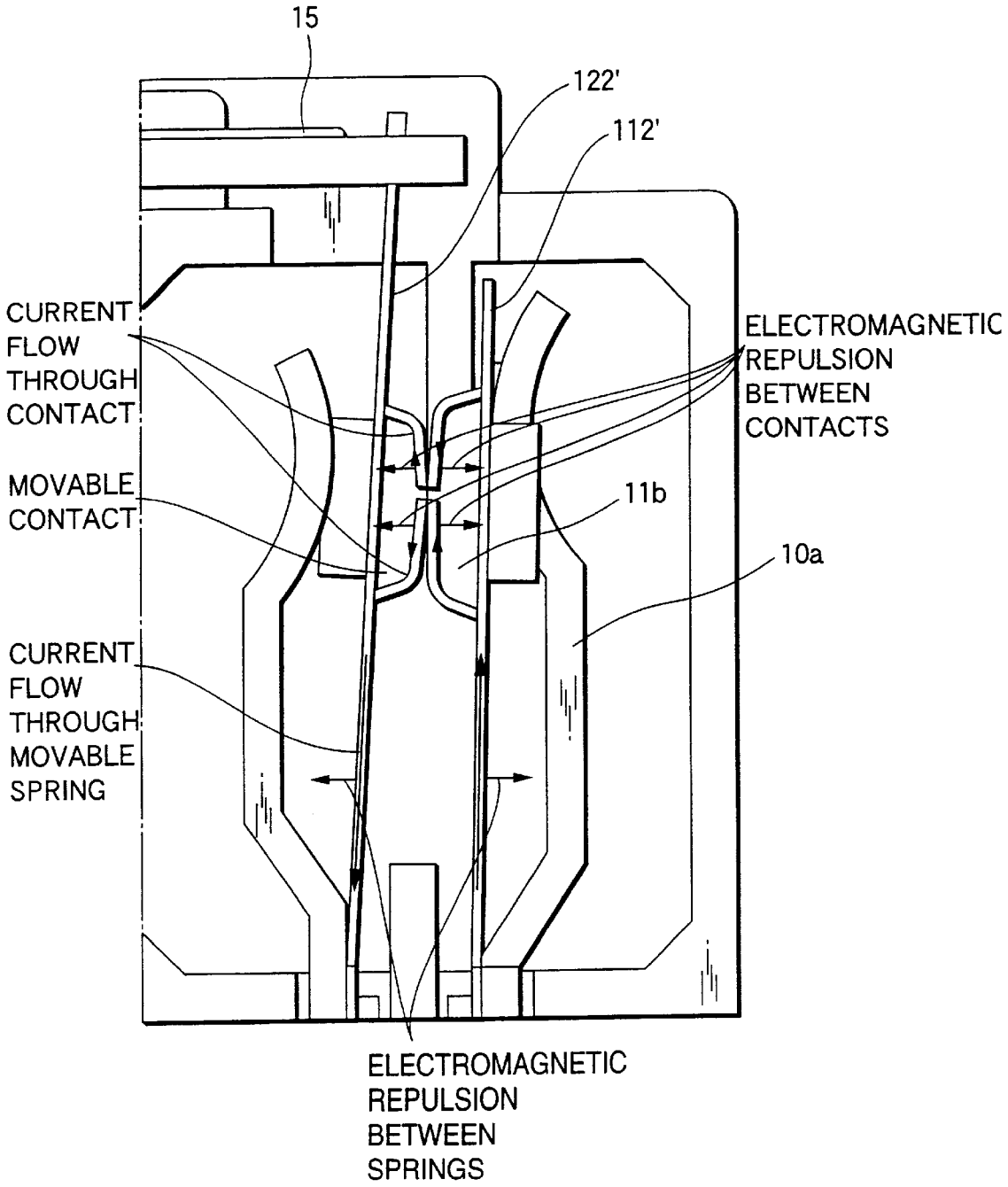

The contact portion 10*a* has another function such that when a short-circuit is generated, a short-circuit current of several hundreds amperes instantaneously flows to a contact of a relay and a spring. At this time, electromagnetic force (which is proportional to a square of the short-circuit current) acts on the contact and the spring in such a direction as to separate the contact as shown in FIG. 26(*b*) (this force is referred to as electromagnetic repulsion). If a contact portion 10*a* serving as a shunt plate is provided, the following effects can be obtained.

Since a movable contact 123' and a fixed contact 11*b* are interposed between a card 15 and the contact portion 10*a* (shunt plate) through the spring, greater electromagnetic repulsion can be suppressed in the contact portion.

Since a current flowing to a fixed contact plate 112' shunts to the contact portion 10*a* (shunt plate) and is decreased, the electromagnetic repulsion to the spring can be reduced.

The fixed terminal 111' has the same shape as that of the movable terminal 121' except that the base end side is bent. Before bending, the fixed terminal 111' has a compatibility with the movable terminal 121'. Therefore, parts can be shared.

The reference numeral 112' denotes a fixed contact plate formed of a metal material like an almost rectangular thin plate with elasticity. The fixed contact plate 112' has a base end caulked and fixed into the tip portion of the fixed terminal 111' and constitutes a fixed terminal block 11' together with the fixed terminal 111'. The fixed contact plate 112' has a pressed portion 11*a* extended from one of sides and a fixed contact 11*b* caulked into a tip portion. The pressed portion 11*a* is pressed from a prepressure rib portion 1001 positioned at the inner side face of the body 161 to be described below as reaction of spring force of the fixed contact plate 112' itself. The fixed contact plate 112' has a spring load in the direction of the displacement of the movable spring 122' by pressing the pressed portion 11*a* from the inner side face of the body 161. Thus, prepressures of the contacts 123' and 11*b* are obtained.

Figure 27A:
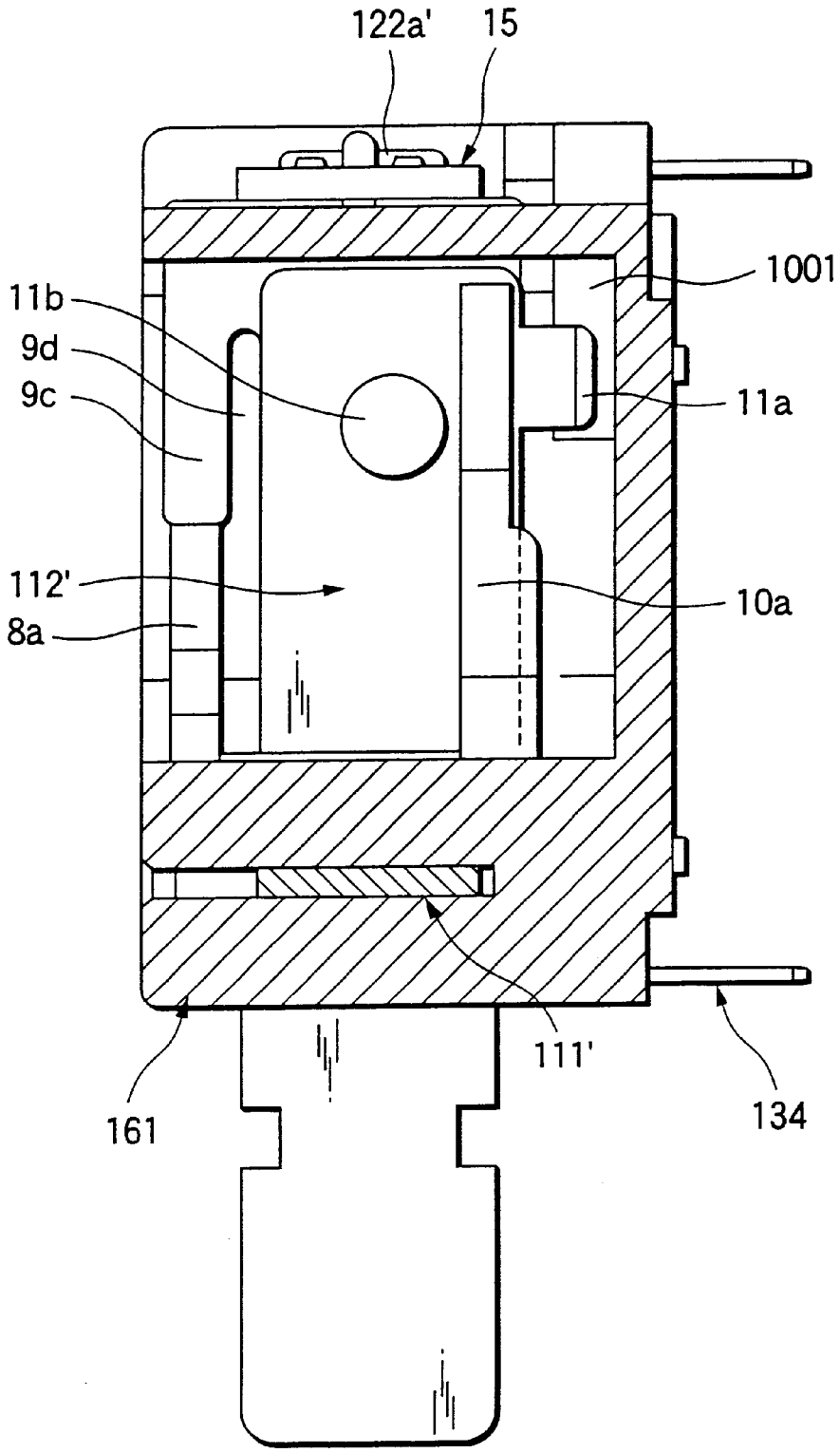
FIG. 27(*a*) is a sectional view taken along the line Y—Y in FIG. 26(*a*).
Figure 27B:
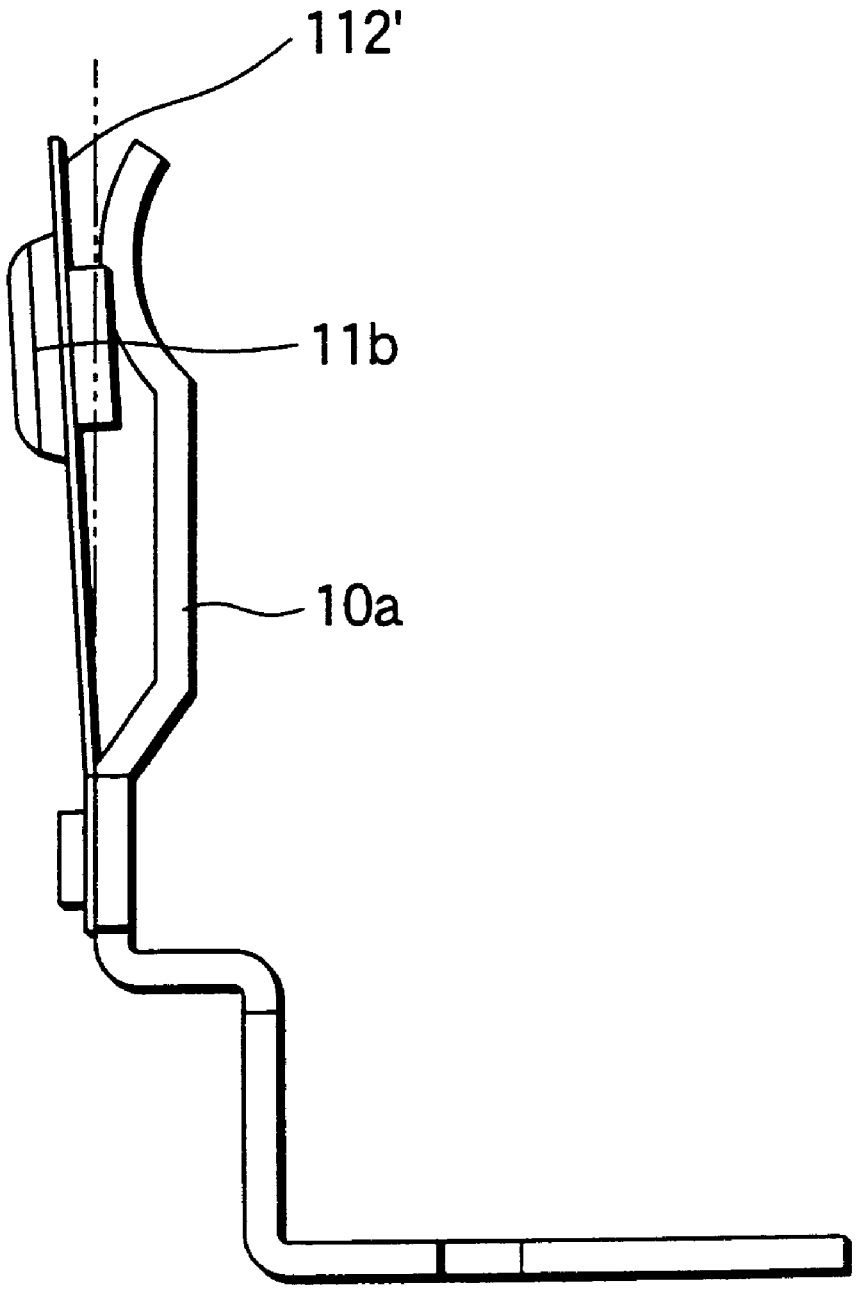
Figure 27C:
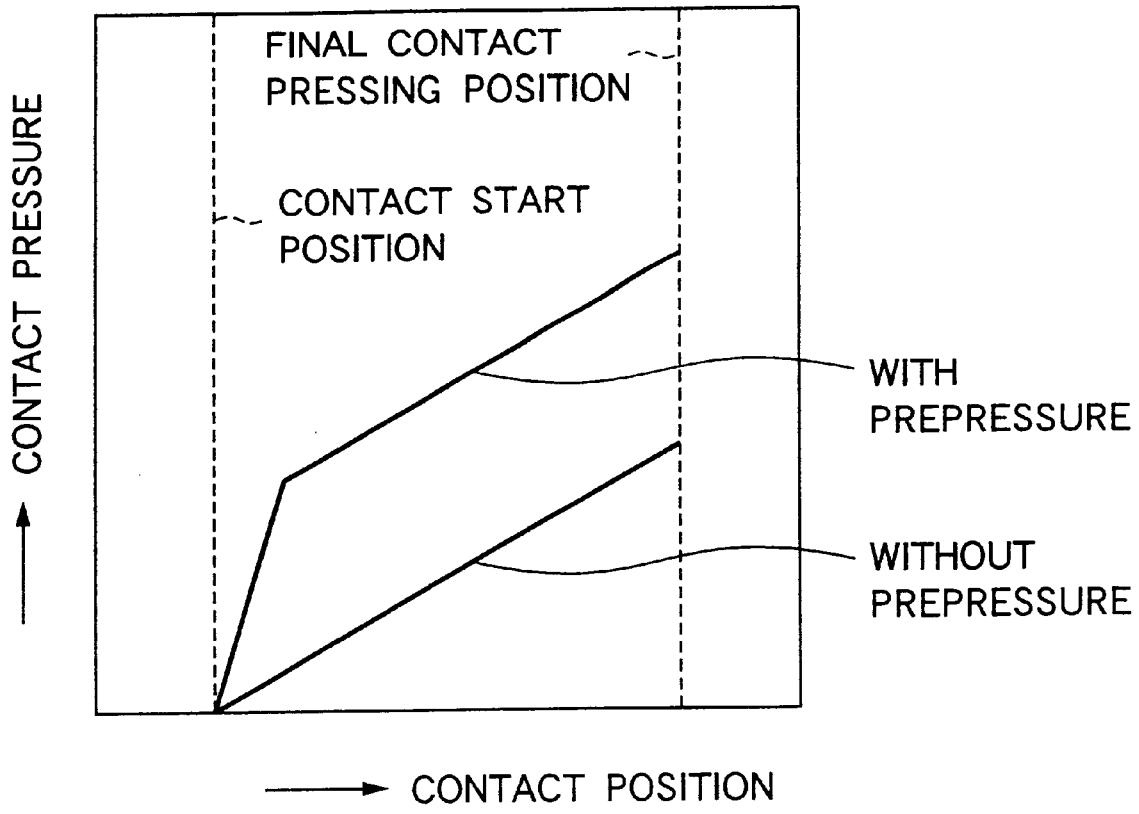

AS shown in FIG. 27(*b*), the fixed contact plate 112' is preliminarily bent from a base toward the left side (moving contact side. When a fixed contact spring block 12' is incorporated into the body 161, the fixed contact plate 112' is set to a predetermined position (as shown in FIG. 27(*a*) through a prepressure rib portion 1001 for a prepressure.

If the pressed portion 11*a* for a prepressure is not provided, in this case, the fixed contact plate 112' is not bent differently from that in FIG. 27(*b*).

FIG. 27(*c*) shows a relationship between a contact position and a contact pressure which is obtained with or without application of the prepresssure. In the case in which the prepressure is applied, a great contact pressure is generated immediately after the contact. Therefore, it is possible to reduce the maintenance of an unstable contact state in which a small contact pressure is generated.

The reference numeral 15 denotes a card formed of a non-conductive material such as plastics to have a rectangular plate shape, for example, and has an insertion hole 12*a* for insertion in an insertion portion 142*c* of the armature 4 provided on one of ends in a longitudinal direction thereof and an insertion hole 15*a* for insertion in an insertion portion 122*a*' of the movable spring 122 provided on the other end. Thus, the card 15 links the armature 4 and the movable spring 122' by inserting the insertion portion 142*c* of the armature 4 in the insertion hole 15*b* and inserting the insertion portion 122*a*' of the movable spring 122' in the insertion hole 15*a*.

The reference numeral 161 denotes a body formed of plastics to have an almost box shape having one of sides opened, for example, and is provided with the above-mentioned parts. In the state of the provision, the movable terminal 121' and the fixed terminal 111' are protruded outward and the coil terminal 134 fixedly penetrating through the body 161 is also protruded outward. The coil terminal 134 is connected to the coil 13.

Next, description will be given to the sensitivity regulation of the abutting and separating operation of both contacts 122' and 11*b*. In the case in which a sensitivity is to be increased, the arm-shaped pressing portion 8*a* of the movable terminal 121' is more bent and plastic deformed toward the movable spring 122' side as compared with the present conditions, thereby increasing the pressing force of the pressing portion 8*a* against the pressed portion 9*c* and the movable spring 122' is elastically deformed toward the fixed contact plate 112' in the direction of the displacement thereof, thereby reducing an opposed distance between both contacts 123' and 11*b*. At this time, if the pressed portion 9*c* of the movable spring 122' is raised and elastically deformed toward the pressing portion 8*a* in the direction of the displacement the pressing force of the pressing portion 8*a* against the pressed portion 9*c* of the movable spring 122' is more increased. Consequently, the amount of elastic deformation of the whole movable spring 122' is more increased. Thus, the sensitivity can be more increased.

To the contrary, if the sensitivity is to be reduced, the arm-shaped pressing portion 8*a* of the movable terminal 121' is bent and elastically deformed toward the opposite side of the movable spring 122' as compared with the present conditions, thereby reducing the pressing force of the pressing portion 8*a* against the pressed portion 9*c* to more increase the opposed distance between the contacts 123' and 11*b*. At this time, if the pressed portion 9*c* of the movable spring 122' is raised and elastically deformed in such a direction as to go away from the pressing portion 8*a* in the direction of the displacement, the pressing force of the pressing portion 8*a* against the pressed portion 9*c* of the movable spring 122' is more reduced so that the amount of elastic deformation of the whole movable spring is more decreased. Therefore, the sensitivity can be more reduced.

Figure 19:
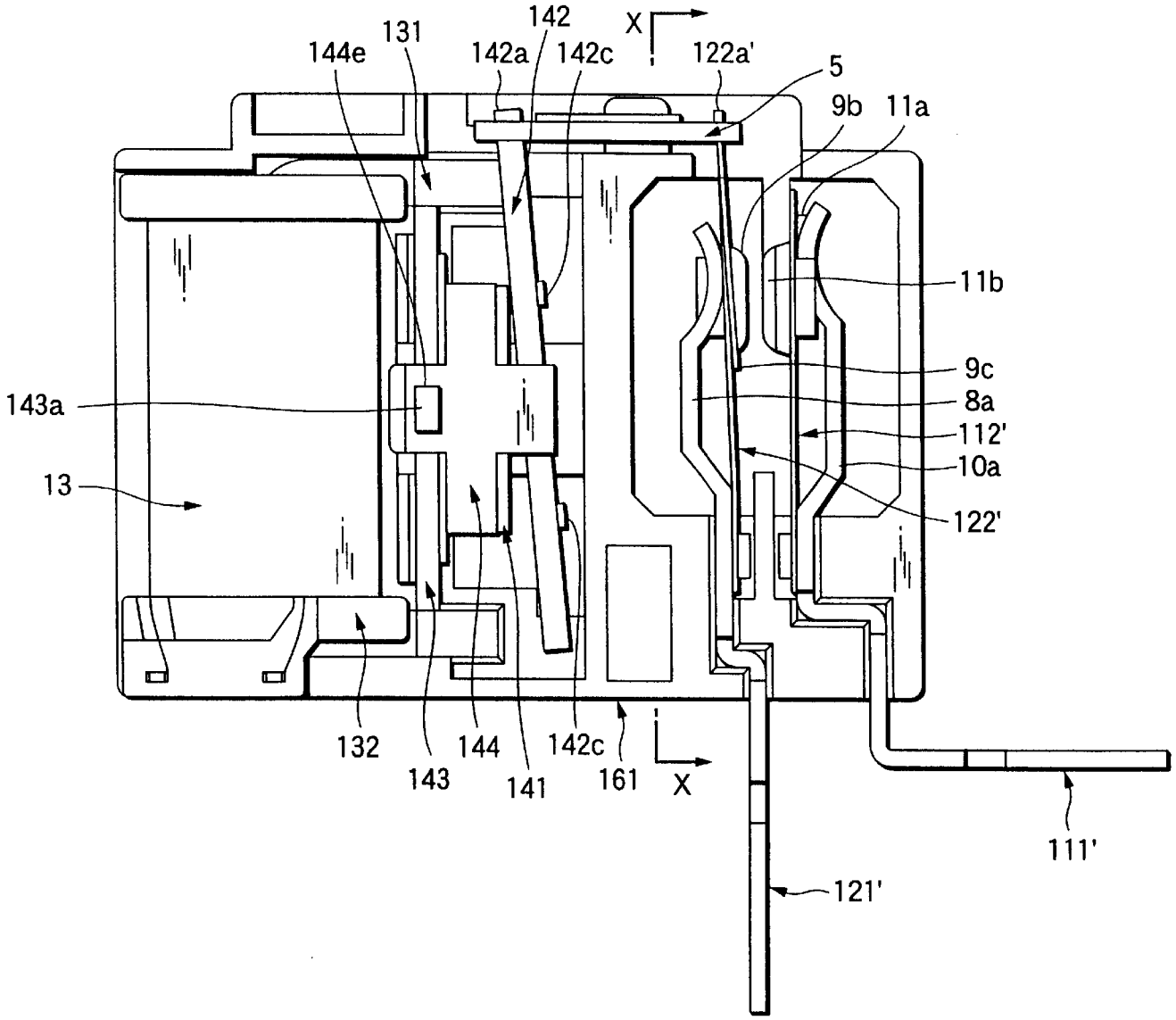
FIG. 19 is a side view showing a contact separating state according to a seventh embodiment of the invention.

Next, the operation will be described. When a current is caused to flow in a preset direction so that the coil 13 is excited, the other end of the armature 4 is attracted into the magnetic pole portion on the other end of the yoke 1 such that a closed magnetic circuit is formed. Consequently, the armature 4 is rotated clockwise in FIG. 19 by using the central piece of the hinge spring 144 as a rotating fulcrum. As a result, the card 15 linked to the armature 4 is driven toward the movable spring 122', and the movable spring 122' linked to the driven card 15 is displaced toward the fixed contact plate 112' so that the moving contact 123' of the movable spring 122' abuts on the fixed contact 11*b* of the fixed contact plate 112'. Consequently, the state shown in FIG. 26(*a*) is obtained. When the excitation of the coil 13 is stopped, this state is held.

When a current is caused to flow in a direction reverse to the above-mentioned direction so that the coil 13 is excited in this state, one of the ends of the armature 4 is attracted into the magnetic pole portion on one of the ends of the yoke 1 such that a closed magnetic circuit is formed. Consequently, the armature 4 is rotated counterclockwise in FIG. 26 by using the central piece of the hinge spring 144 as a rotating fulcrum. As a result, the card 15 linked to the armature 142 is driven in such a direction as to go away from the movable spring 122', and the movable spring 122' linked to the driven card 15 is displaced apart from the fixed contact plate 112' so that the moving contact 123' of the movable spring 122' is separated from the fixed contact 11*b* of the fixed contact plate 112'. When the excitation of the coil 13 is stopped, this state is held.

In such an electromagnetic relay, if the opposed distance between the contacts 123 and 11*b* is adjusted to be smaller by the elastic deformation of the movable spring 122 in the direction of the displacement, the sensitivity of the abutting and separating operation of the contacts 123 and 11*b* is increased. To the contrary, if the opposed distance between the contacts 123' and 11*b* is adjusted to be longer, the sensitivity of the abutting and separating operation of the contacts 123' and 11*b* is reduced. Thus, the sensitivity of the abutting and separating operation of the contacts 123' and 11*b* can be regulated. Thus, the sensitivity of the abutting and separating operation of the contacts 123' and 11*b* is regulated by the elastic deformation of the movable spring 122' in the direction of the displacement. Therefore it is not necessary to provide a clearance for sensitivity regulation between the magnetic pole portions of the yoke 1 and the armature 4. Consequently, suction force is not varied so that the sensitivity of the abutting and separating operation of the contacts 123' and 11*b* can be regulated easily.

Moreover, the movable spring 122' is elastically deformed by the pressing portion 8*a* in the direction of the displacement. Therefore, the amount of elastic deformation can be regulated by increasing or reducing the pressing force of the pressing portion 8*a*. Furthermore, the sensitivity of the abutting and separating operation of the contacts 122*a*' and 11*a* can be regulated easily.

Furthermore, the pressing portion 8*a* is provided on the movable terminal 121' itself. Therefore, it is not necessary to provide the pressing portion 8*a* on the body 161, for example, by particularly paying attention such that the pressing portion 8*a* does not abut on the movable terminal 121' to cause a mutual interference. Thus, assembly can be carried out easily.

Moreover, the spring force of the pressed portion 9*c* of the movable spring 122' is locally reduced. Therefore, the whole movable spring 122' can be slightly elastically deformed in the direction of the displacement. Consequently, the sensitivity of the abutting and separating operation of the contacts 123' and 11*b* can be regulated with high precision.

Furthermore, the press state of the pressing portion 8*a* can be adjusted by elastically deforming the pressed portion 9*c* of the movable spring 122' in the direction of the displacement. Therefore, the elastic deformation can be slightly adjusted in the direction of the displacement. Thus, the sensitivity of the abutting and separating operation of the contacts 123' and 11*b* can be regulated with high precision.

Moreover, the current also flows to the contact portion 10*a* extended from the fixed terminal 111' as well as the fixed contact plate 11 when the contacts 123' and 11*b* abut. Therefore, the current flowing to the fixed contact plate 112' can be reduced so that heat generation can be suppressed. In addition, the contact portion 10*a* is not in contact with the base end of the fixed contact plate 112' but the vicinity of the fixed contact 11*b* and constitutes a parallel circuit together with the fixed contact plate 112 over the almost whole fixed contact plate 112 in a longitudinal direction thereof. Consequently, it is possible to enhance the effect of suppressing the heat generation of the fixed contact plate 112.

Furthermore, when the contact portion 10*a* extended from the fixed terminal 111 is elastically deformed in the direction of the displacement of the movable spring 122' to shift a contact position and the fixed contact plate 112' is thus elastically deformed in the direction of the displacement of the movable spring 122', the opposed distance between the contacts 123' and 11*b* can be regulated. Consequently, it is also possible to regulate the sensitivity of the abutting and separating operation of the contacts 123' and 11*b*.

Moreover, the fixed contact plate 112' comes in contact with the contact portion 10*a* of the fixed terminal 111' on the opposite side of the moving contact 123' during the abutment of the contacts. Therefore, a contact bounce can be decreased.

Furthermore, the fixed contact plate 112' obtains the prepressures of the contacts 123' and 11*b*. Therefore, a contact pressure can be obtained through the abutment of the contacts 123' and 11*b*.

Moreover, in a state in which the movable terminal block 12' is provided on the body 161, the pressed portion 9*c* of the movable spring 122' and the pressing portion 8*a* of the movable terminal 121' are placed in outermost positions as shown in FIG. 20. Therefore, it is possible to easily carry out a deforming work for regulating the sensitivity of the abutting and separating operation of the contacts 123' and 11*b*.

Furthermore, both the pressing portion 8*a* of the movable terminal 121 and the contact portion 10*a* of the fixed terminal 111' are almost arcuate arm-shaped. Therefore, it is possible to easily carry out elastically deformation in the direction of the displacement of the movable spring 122'.

Moreover, both the pressing surface of the pressing portion 8*a* of the movable terminal 121' and the contact surface of the contact portion 10*a* of the fixed terminal 111' are curved. Therefore, the movable spring 122' and the fixed contact plate 111' are worn with difficulty so that metal powder is generated with difficulty. Consequently, the metal powder is rarely stuck to the contacts 123' and 11*b* so that contact failures are caused with difficulty.

While the sensitivity of the abutting and separating operation of the contacts 123' and 11*b* is regulated by the elastic deformation of the pressing portion 8*a* of the movable terminal 121' and the pressed portion 9*c* of the movable spring 122' in the present embodiment, the sensitivity can also be regulated by the elastic deformation of one of them.

Although the fixed contact plate 112' has elasticity in the present embodiment, the sensitivity of the abutting and separating operation of the contacts 123' and 11*b* can be regulated by the elastic deformation of the movable spring 122' in the direction of the displacement even if the fixed contact plate 112' does not have the elasticity.

Figure 28:
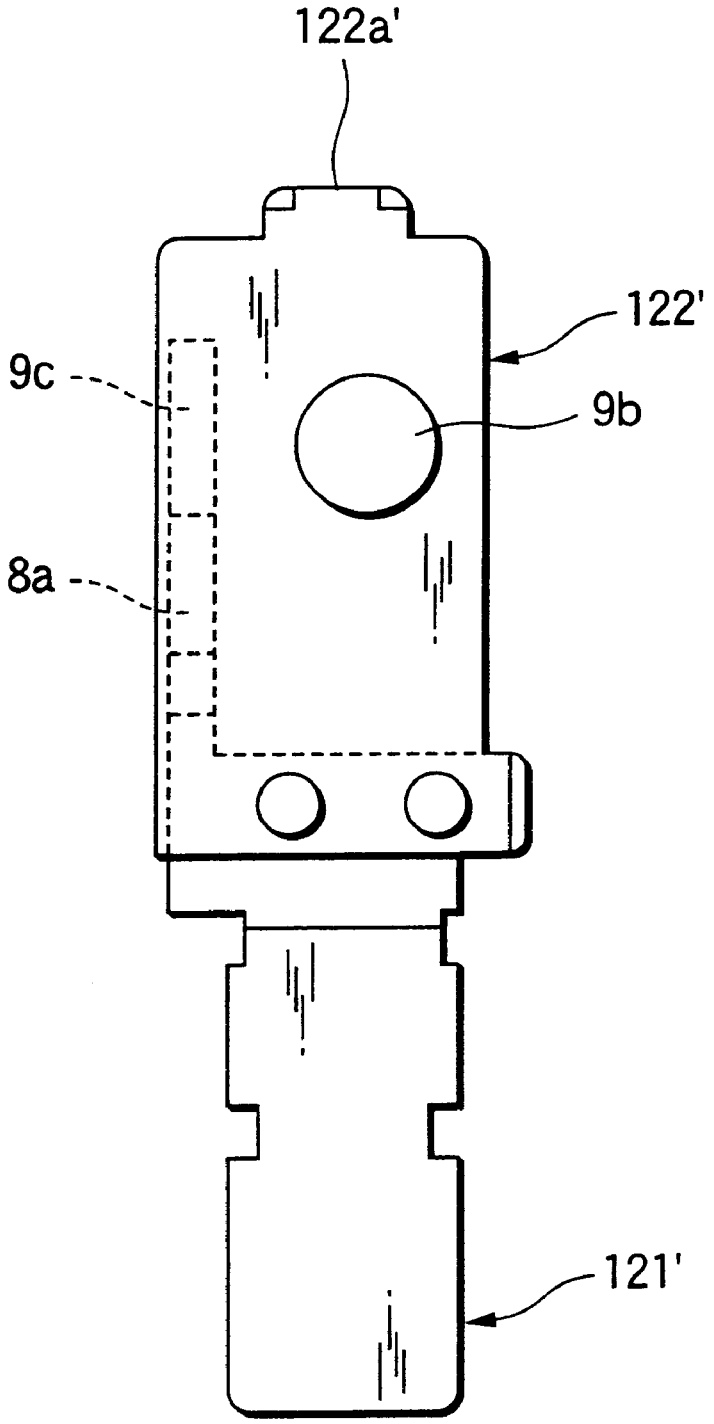
FIG. 28 is a front view showing the moving terminal block provided with a movable spring having no cut portion.

While the cut portion 9*d* is provided on the movable spring 122' to locally reduce the spring force of the pressed portion 9*c* in the present embodiment, the movable spring 122' having no cut portion 9*d* may be used as shown in FIG. 28 if the sensitivity does not need to be regulated slightly, for example.

Figure 29:
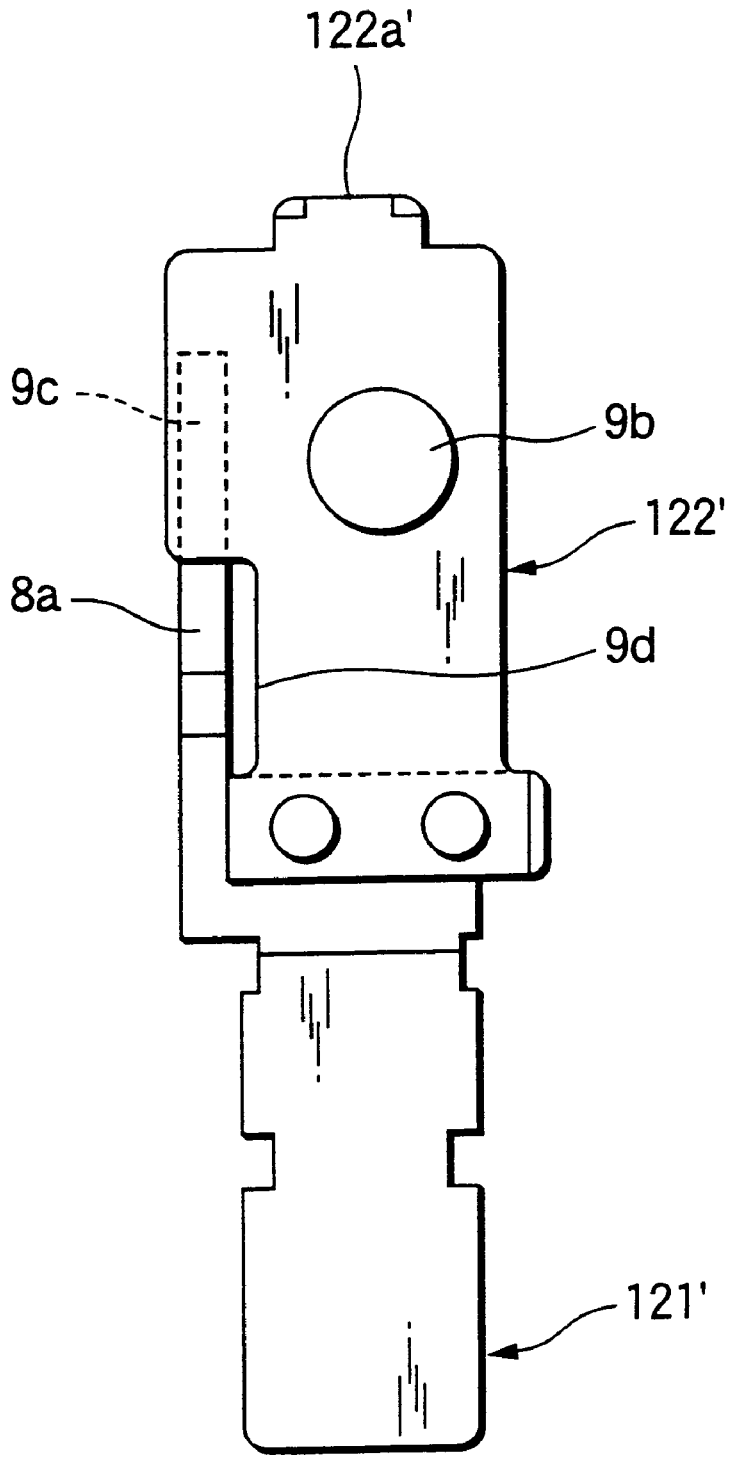
FIG. 29 is a front view showing g the moving terminal block provided with the movable spring having a notch-shaped cut portion.

Although the slit-shaped cut portion 9*d* of the movable spring 122' is provided and the pressed portion 9*c* can be raised and elastically deformed in the present embodiment, the movable spring 122' having a simply notch-shaped cut portion 9*d* may be used as shown in FIG. 29 if the sensitivity does not need to be regulated slightly, for example.

While a polarized relay including the permanent magnet 7 is used in the present embodiment, a so-called non-polarized relay including no permanent magnet 7 can obtain the same effects.

What is claimed is:

1. An electromagnetic relay comprising:

a yoke having two ends bent in a first direction;

a coil portion wound onto a central part between the ends of the yoke;

a permanent magnet arranged between the ends of the yoke;

an armature formed to have a greater length than that between the ends of the yoke and provided on a first side of the permanent magnet;

a hinge spring capable of causing both end sides of the armature to be toggle with respect to the ends of the yoke, and the hinge spring integrally fixing the permanent magnet and the armature;

an auxiliary yoke having a length which is approximately equal to the length defined between the ends of the yoke and provided on the other side of the permanent magnet opposite to the one side of the permanent magnet, wherein the permanent magnet is formed as a plate having a smaller length than that between the ends of the yoke, the armature is formed as a plate and having a protrusion on a surface opposed to the permanent magnet, the hinge spring is defined by a central part attached to a surface on one side in the armature and both side parts extended from the central part along the armature to attach to both side faces of the auxiliary yoke respectively to hold the permanent magnet, and the hinge spring integrally fix the permanent magnet, the armature and auxiliary yoke.

2. The electromagnetic relay according to claim 1, the permanent magnet is formed as a plate having a length which is almost equal to a length defined between the ends of the yoke, the armature is formed as a plate and has a protrusion on a surface opposed to the permanent magnet, the hinge spring is defined by a central part attached to a surface on one side in the armature and both side parts extended from the central part along the armature to attach to both side faces of the permanent magnet respectively, and the permanent magnet and the armature are integrally fixed with the hinge spring.

3. The electromagnetic relay according to claim 1, further comprising:

a fixed contact spring block including a fixed side terminal, a leaf spring fastened to the fixed side terminal, and a fixed contact provided on the leaf spring;

a moving contact spring block including a moving side terminal, a leaf spring fastened to the moving side terminal and a moving contact provided on the leaf spring; and a card, attached to both of the armature and the moving contact spring block, for causing the fixed contact and the moving contact to come in contact with or separate from each other depending on a toggle motion of the armature.

4. The electromagnetic relay according to claim 1, further comprising:

a disengage prevention structure arranged on the auxiliary yoke for preventing hinge spring from being disengaged.

5. The electromagnetic relay according to claim 4, the hinge spring has a hole on each of both ends, the auxiliary yoke has a protrusion fitted in each hole on the both ends, and the protrusion is bent in a first direction and serves as the disengagege prevention structure.

6. The electromagnetic relay according to claim 4, the hinge spring has a hole on each of both ends and the auxiliary yoke has a protrusion fitted in each hole on the both ends, the protrusion having a V-shaped groove, serving as the disengaging prevention structure, for fitting the peripheral portions of the corresponding holes of the ends on the surface in a second direction opposite to the first direction.

7. The electromagnetic relay according to claim 4, the hinge spring has a hole on each of both ends, the auxiliary yoke has a protrusion fitted in each hole on the both ends, and the protrusion has, as the disengagement prevention structure, a hook-shaped click portion extended in the second direction.

8. The electromagnetic relay according to any of claim 1, wherein the portion of the movable spring which is to be pressed by the pressing portion is flexibly deformed in the direction of the displacement.

* * * * *